US006140892A

United States Patent [19]

Uda et al.

[11] Patent Number: 6,140,892

[45] Date of Patent: Oct. 31, 2000

[54] DISTRIBUTED CONSTANT CIRCUIT

[75] Inventors: Hisanori Uda, Hirakata; Masao Nishida, Sakai, both of Japan

[73] Assignee: Sanyo Electric Co., Ltd., Osaka-fu, Japan

[21] Appl. No.: 09/145,910

[22] Filed: Sep. 2, 1998

[30] Foreign Application Priority Data

| | | | |
|---|---|---|---|
| Sep. 4, 1997 | [JP] | Japan | 9-240074 |
| Feb. 16, 1998 | [JP] | Japan | 10-032498 |
| Aug. 20, 1998 | [JP] | Japan | 10-234649 |

[51] Int. Cl.[7] ..... H01P 1/203; H01P 5/00

[52] U.S. Cl. ..... 333/204; 330/302; 333/246

[58] Field of Search ..... 333/33, 35, 204, 333/206, 246; 330/302

[56] References Cited

U.S. PATENT DOCUMENTS

| | | | |
|---|---|---|---|
| 5,202,649 | 4/1993 | Kashiwa | 333/33 |
| 5,272,456 | 12/1993 | Ishida | 333/246 |
| 5,592,122 | 1/1997 | Masahiro et al. | 330/302 X |

OTHER PUBLICATIONS

Tetsuo Hirota, et al., "Reduced–Size Branch–Line and Rat–Race Hybrids for Uniplanar MMIC's", *IEEE Transactions On Microwave Theory And Techniques*, vol. 38, No. 3, pp. 270–275 (Mar. 1990).

David Kinzel, et al., "Measurement Based Behavioral Modeling of Impendance Dependent Transistor Non–Linearity", *1997 Wireless Communications Conference* pp. 114–116 (1997).

ATN Microwave, Inc. "A Load Pull System With Harmonic Tuning", *Microwave Journal* pp. 128, 130, 132, (Mar. 1996).

S. Makioka, et al., "A Miniaturized GaAs Power Amplifier for 1.5 GHz Digital Cellular Phones", *IEEE 1996 Microwave and Millimeter–Wave Monolithic Circuits Symposium* pp. 13–16 (1996).

Seiichi Banba, et al., "Small–Sized MMIC Amplifiers Using Thin Dielectric Layers" *IEEE Transactions On Microwave Theory And Techniques*, vol. 43, No. 3 pp. 485–492, (Mar. 1995).

Kazuhiko Honjo, "Microwave Nonlinear Circuit" *MWE '95 Microwave Workshop Digest* pp. 65–74 (1995).

Kazuhisa Yamauchi, et al., "A Novel Series Diode Linearizer for Mobile Radio Power Amplifiers", *1996 IEEE MTT–S Digest* pp. 831–834 (1996).

*Primary Examiner*—Paul Gensler

*Attorney, Agent, or Firm*—Akin, Gump, Strauss, Hauer & Feld, L.L.P.

[57] ABSTRACT

In a distributed constant circuit, a first line is connected between a first node and a second node. The first node is grounded through a series connection between a first capacitor and a second line, and the second node is grounded through a series connection between a second capacitor and a third line. The parameters of the first, second and third lines and the first and second capacitors satisfy a predetermined relational expression such that characteristics equivalent to a λ/4 line are obtained with respect to the frequency of a fundamental wave, and the second and third lines and the first and second capacitors respectively resonate with respect to an arbitrary frequency.

16 Claims, 22 Drawing Sheets

DISTRIBUTED CONSTANT CIRCUIT

BACKGROUND OF THE INVENTION

1. Field of the Invention

The present invention relates to a distributed constant circuit, a high-frequency circuit and a bias applying circuit using the same, and an impedance adjusting method.

2. Description of the Background Art

In recent years, as mobile communication has been rapidly developed, electronic waves having a great many frequencies have been required for the communication, and the frequencies of the electronic waves used in the mobile communication are shifting to a microwave band. Therefore, an amplifier used for a portable machine is constituted by a monolithic microwave integrated circuit (MMIC) and a microwave integrated circuit (MIC) modularized.

As an amplifier for amplifying a signal having a desired frequency, a bias applying circuit for applying a predetermined DC bias to the gate and the drain of a field-effect transistor (FET) is used. The bias applying circuit is constituted by a distributed constant line (hereinafter referred to as a λ/4 line) having a length which is one-fourth the wavelength of a fundamental wave, for example.

When one end of the λ/4 line is short-circuited to a ground potential in an AC manner, the other end thereof enters an open state with respect to the frequency of the fundamental wave (hereinafter referred to as a fundamental frequency). The λ/4 line is widely applied to various types of circuits such as a distributor, a synthesizer, a directional coupler, and a filter in addition to the bias applying circuit to the FET.

However, the lower the fundamental frequency is, the larger the length of the λ/4 line is, thereby increasing the size of a chip or a module at frequencies which are not more than several gigahertz. Therefore, a method of miniaturizing the λ/4 line has been examined.

FIG. 37 is a diagram showing a λ/4 line, and FIG. 38 is a diagram showing a conventional distributed constant circuit equivalent to the λ/4 line. In FIG. 37, $Z_0$ is the characteristic impedance of a λ/4 line 100, and $L_0$ is the length of the λ/4 line 100. In FIG. 38, $Z_1$ is the characteristic impedance of a line 101, $L_1$ is the length of the line 101, and $C_1$ is the capacitance value (capacitance) of capacitors 102 and 103.

In the distributed constant circuit shown in FIG. 38, the line 101 is connected between a node NA and a node NB, the node NA is grounded through the capacitor 102, and the node NB is grounded through the capacitor 103.

If the characteristic impedance $Z_1$, the length $L_1$ and the capacitance value $C_1$ satisfy relations expressed by the following equations (12) and (13), the distributed constant circuit shown in FIG. 38 is equivalent to the λ/4 line 100 shown in FIG. 37 at a fundamental frequency (see an article entitled by Tetsuo Hirota, Akira Minakawa, Masahiro Muraguchi, "Reduced-Size Branch-Line and Rat-Race Hybrids for Uniplanar MMIC's", IEEE MTT. Vol. 38, No. 3, March 1990):

$$Z_1 = \frac{Z_0}{\sin\frac{2\pi}{\lambda}L_1} \tag{12}$$

$$C_1 = \frac{1}{\omega Z_0}\cos\frac{2\pi}{\lambda}L_1 \tag{13}$$

where λ is the wavelength of a fundamental wave, and ω is the angular velocity of the fundamental wave. In the foregoing equations (12) and (13), the length $L_1$ of the line 101 can be arbitrarily selected, so that the length $L_1$ of the line 101 can be reduced.

FIG. 39 is a circuit diagram of a bias applying circuit using the distributed constant circuit shown in FIG. 38. A bias applying circuit 110 shown in FIG. 39 functions as a drain bias applying circuit for applying a drain bias $V_{dd}$ to a FET 200.

In the bias applying circuit 110 shown in FIG. 39, a line 101 is connected between a node NA and a node NB, and the node NA is grounded through a capacitor 111. The drain bias $V_{dd}$ is applied to the node NA. The node NB is grounded through a capacitor 103, and is connected to the drain of the FET 200.

$Z_1$ is the characteristic impedance of the line 101, and $L_1$ is the length of the line 101. $C_1$ is the capacitance value of the capacitor 103, and $C_g$ is the capacitance value of the capacitor 111. $Z_{fr}$ is an impedance in a case where an input side (a terminal A) is viewed from the node NB, and $Z_{10}$ is an impedance in a case where an output side (a terminal B) is viewed from the node NB. The impedance $Z_{fr}$ and the impedance $Z_{10}$, are taken as 50Ω.

The capacitor 111 has a sufficiently small impedance relative to the fundamental frequency. Therefore, the node NA is short-circuited to a ground potential in an AC manner. Consequently, the node NB enters an open state with respect to the fundamental frequency. That is, the bias applying circuit 110 shown in FIG. 39 functions as λ/4 line with respect to the fundamental frequency. In this case, the drain bias $V_{dd}$ is applied to the node NA.

On the other hand, when the λ/4 line 100 of FIG. 37 is used as a drain bias applying circuit to the FET, one end of the λ/4 line 100 is grounded through a capacitor, and the other end is connected to the drain of the FET. In this case, the other end of the λ/4 line 100 enters an open state with respect to the fundamental frequency, and enters a short-circuited state with respect to even-order harmonics.

It has been known that in load conditions under which a short-circuited state occurs with respect to even-order harmonics (particularly second harmonics) in a B-class operation, the power-added efficiency of an amplifier which is constituted by a FET is improved. When the λ/4 line 100 is used as a bias applying circuit, therefore, the efficiency of the amplifier can be increased.

In a case of an A-class or AB-class operation of an amplifier, however, the conditions are not necessarily most suitable. In this case, it is necessary to adjust a harmonic impedance (particularly second harmonics) such that the characteristics of the amplifier are most suitable (see "A Load Pull system with Harmonic Tuning", Microwave Journal, pp. 128–132, March 1996).

Meanwhile, when the distributed constant circuit shown in FIG. 38 is used as a bias applying circuit for a B-class amplifier as shown in FIG. 39, the node NB does not enter a short-circuited state with respect to even-order harmonics. Although an amplifier can be miniaturized, therefore, high efficiency of a B-class amplifier cannot be achieved.

Further, when the distributed constant circuit is used for an A-class or AB class operation, high efficiency can not be achieved because a harmonic impedance is fixed.

In the amplifier which is constituted by the FET, the FET may, in some cases, oscillate in a high-frequency region. As measures to prevent the FET from oscillating, there is a method of significantly decreasing gain at an oscillation frequency. When the λ/4 line 100 shown in FIG. 37 is used as a bias applying circuit, the gain of the amplifier can be decreased at even-order harmonics, while the gain thereof at the other frequencies cannot be decreased. Therefore, a bias applying method capable of decreasing gain at an arbitrary frequency is demanded.

Furthermore, in an amplifier and a mixer, spurious (a signal having an unnecessary frequency) may, in some cases, be a problem. Therefore, measures to suppress spurious signals is demanded.

SUMMARY OF THE INVENTION

An object of the present invention is to provide a distributed constant circuit which has characteristics equivalent to a λ/4 line with respect to a fundamental wave, can be miniaturized, and can suppress an arbitrary frequency, and a high-frequency circuit using the same.

Another object of the present invention is to provide a bias applying circuit which can be miniaturized and increased in efficiency.

Still another object of the present invention is to provide an impedance adjusting method for adjusting a load impedance of a transistor in a bias applying circuit.

A further object of the present invention is to provide a distributed constant circuit which can be miniaturized and lowered in cost.

A distributed constant circuit according to the present invention comprises a first line, a first capacitor, a second line connected in series with the first capacitor, a second capacitor, and a third line connected in series with the second capacitor, one end of the first line being connected to a predetermined reference potential through a series connection between the first capacitor and the second line, and the other end of the first line being connected to the reference potential through a series connection between the second capacitor and the third line, characteristics equivalent to a line having a length which is one-fourth a wavelength corresponding to a first frequency being obtained with respect to the first frequency, and the first capacitor and the second line resonating and the second capacitor and the third line resonating with respect to a second frequency different from the first frequency.

In the distributed constant circuit, the characteristics equivalent to the line having a length which is one-fourth the wavelength corresponding to the first frequency are obtained with respect to the first frequency. When one of the one end and the other end of the first line is short-circuited to the reference potential in an AC manner, therefore, the other of the one end and the other end of the first line enters an open state with respect to the first frequency.

The first capacitor and the second line resonate and the second capacitor and the third line resonate with respect to the second frequency. Therefore, the one end and the other end of the first line are short-circuited to the reference potential with respect to the second frequency.

In this case, the parameters of the first, second and third lines and the first and second capacitors are adjusted, thereby making it possible to shorten the first, second and third lines as well as to arbitrarily set the second frequency.

Consequently, there is provided a distributed constant circuit which has characteristics equivalent to a λ/4 line, can be miniaturized, and can suppress an arbitrary frequency.

It is preferable that the characteristic impedance $Z_a$ of the first line, the length $L_a$ of the first line, the characteristic impedance $Z_b$ of the second and third lines, the length $L_b$ of the second and third lines, the capacitance value C of the first and second capacitors, a first frequency $f_1$, a wavelength $\lambda_1$ corresponding to the first frequency, a second frequency $f_2$, and a wavelength $\lambda_2$ corresponding to the second frequency satisfy relations expressed by equations (1), (2) and (3):

$$L_a = \frac{\lambda_1}{2\pi}\arctan\left\{\frac{1}{Z_a}\left(\frac{1}{2\pi f_1 C} - Z_b \tan\frac{2\pi}{\lambda_1}L_b\right)\right\} \tag{1}$$

$$L_b = \frac{\lambda_2}{2\pi}\arctan\frac{1}{C\cdot 2\pi f_2 Z_b} \tag{2}$$

$$Z_a = \frac{Z_0}{\sin\frac{2\pi}{\lambda_1}L_a} \tag{3}$$

In the distributed constant circuit, by satisfying the equation (3), voltage/current characteristics equivalent to the line having a length which is one-fourth the wavelength corresponding to the first frequency are obtained with respect to the first frequency.

By satisfying the equation (2), the first capacitor and the second line resonate and the second capacitor and the third line resonate with respect to the second frequency. Therefore, the one end and the other end of the first line are short-circuited to the reference potential with respect to the second frequency.

Furthermore, by satisfying the equation (1), when one of the one end and the other end of the first line is short-circuited to the reference potential in an AC manner, the other of the one end and the other end of the first line enters an open state with respect to the first frequency.

In this case, the parameters of the first, second and third lines and the first and second capacitors are adjusted, thereby making it possible to shorten the first, second and third lines as well as to arbitrarily set the second frequency.

Consequently, there is provided a distributed constant circuit which has characteristics equivalent to a λ/4 line, can be miniaturized, and can suppress an arbitrary frequency.

A distributed constant circuit according to another aspect of the present invention comprises a first line, a capacitor, and a second line connected in series with the capacitor, one end of the first line being connected to a predetermined reference potential in an AC manner, and the other end of the first line being connected to the reference potential through a series connection between the capacitor and the second line, characteristics equivalent to a line having a length which is one-fourth a wavelength corresponding to a first frequency being obtained with respect to the first frequency, and the capacitor and the second line resonating with respect to a second frequency different from the first frequency.

In the distributed constant circuit, the characteristics equivalent to the line having a length which is one-fourth the wavelength corresponding to the first frequency are obtained with respect to the first frequency. Consequently, the other end of the first line enters an open state with respect to the first frequency.

The capacitor and the second line resonate with respect to the second frequency. Therefore, the other end of the first line is short-circuited to the reference potential with respect to the second frequency.

In this case, the parameters of the first and second lines and the capacitor are adjusted, thereby making it possible to shorten the first and second lines as well as to arbitrarily set the second frequency.

Consequently, there is provided a distributed constant circuit which has characteristics equivalent to a λ/4 line, can be miniaturized, and can suppress an arbitrary frequency.

It is preferable that the characteristic impedance $Z_a$ of the first line, the length $L_a$ of the first line, the characteristic impedance $Z_b$ of the second line, the length $L_b$ of the second line, the capacitance value C of the capacitor, a first frequency $f_1$, a wavelength $\lambda_1$ corresponding to the first frequency, a second frequency $f_2$, and a wavelength $\lambda_2$ corresponding to the second frequency satisfy relations expressed by equations (1), (2) and (3):

$$L_a = \frac{\lambda_1}{2\pi}\arctan\left\{\frac{1}{Z_a}\left(\frac{1}{2\pi f_1 C} - Z_b \tan\frac{2\pi}{\lambda_1}L_b\right)\right\} \quad (1)$$

$$L_b = \frac{\lambda_2}{2\pi}\arctan\frac{1}{C\cdot 2\pi f_2 Z_b} \quad (2)$$

$$Z_a = \frac{Z_0}{\sin\frac{2\pi}{\lambda_1}L_a} \quad (3)$$

In the distributed constant circuit, by satisfying the equation (3), voltage/current characteristics equivalent to he line having a length which is one-fourth the wavelength corresponding to the first frequency are obtained with respect to the first frequency.

By satisfying the equation (2), the capacitor and the second line resonate with respect to the second frequency. Therefore, the other end of the first line is short-circuited to the reference potential with respect to the second frequency.

Furthermore, by satisfying the equation (1), the other end of the first line enters an open state with respect to the first frequency.

In this case, the parameters of the first and second lines and the capacitor are adjusted, thereby making it possible to shorten the first and second lines as well as to arbitrarily set the second frequency.

Consequently, there is provided a distributed constant circuit which has characteristics equivalent to a $\lambda/4$ line, can be miniaturized, and can suppress an arbitrary frequency.

The one end of the first line may be connected to a bias voltage, and the other end of the first line may be connected to an electrode of a transistor.

The first frequency may be the frequency of a fundamental wave, and the second frequency may be higher than the frequency of second harmonics relative to the fundamental wave.

A distributed constant circuit according to still another aspect of the present invention comprises a first line, a first capacitor, a second line connected in series with the first capacitor, a first impedance element, a second capacitor, a third line connected in series with the second capacitor, and a second impedance element, one end of the first line being connected to a predetermined reference potential through a series connection between the first capacitor and the second line and connected to the reference potential through the first impedance element, and the other end of the first line being connected to the reference potential through a series connection between the second capacitor and the third line and connected to the reference potential through the second impedance element, characteristics equivalent to a line having a length which is one-fourth a wavelength corresponding to a first frequency being obtained with respect to the first frequency, and the first capacitor and the second line resonating and the second capacitor and the third line resonating with respect to a second frequency different from the first frequency.

In the distributed constant circuit, the characteristics equivalent to the line having a length which is one-fourth the wavelength corresponding to the first frequency are obtained with respect to the first frequency. When one of the one end and the other end of the first line is short-circuited to the reference potential in an AC manner, therefore, the other of the one end and the other end of the first line enters an open state with respect to the first frequency.

The first capacitor and the second line resonate and the second capacitor and the third line resonate with respect to the second frequency. Therefore, the one end and the other end of the first line are short-circuited to the reference potential with respect to the second frequency.

In this case, the parameters of the first, second and third lines and the first and second capacitors are adjusted, thereby making it possible to shorten the first, second and third lines as well as to arbitrarily set the second frequency.

Consequently, there is provided a distributed constant circuit which has characteristics equivalent to a $\lambda/4$ line, can be miniaturized, and can suppress an arbitrary frequency.

It is preferable that the characteristic impedance $Z_a$ of the first line, the length $L_a$ of the first line, the characteristic impedance $Z_b$ of the second and third lines, the length $L_b$ of the second and third lines, the capacitance value C of the first and second capacitors, the impedance $Z_c$ of the first and second impedance elements, a first frequency $f_1$, a wavelength $\lambda_1$ corresponding to the first frequency, a second frequency $f_2$, and a wavelength $\lambda_2$ corresponding to the second frequency satisfy relations expressed by equations (4), (5) and (6):

$$L_a = \frac{\lambda_1}{2\pi}\arctan\left\{\frac{\frac{jZ_c}{Z_a}\left(\frac{1}{j2\pi f_1 C} + jZ_b\tan\frac{2\pi}{\lambda_1}L_b\right)}{Z_c + \frac{1}{j2\pi f_1 C} + jZ_b\tan\frac{2\pi}{\lambda_1}L_b}\right\} \quad (4)$$

$$L_b = \frac{\lambda 2}{2\pi}\arctan\frac{1}{C\cdot 2\pi f_2 Z_b} \quad (5)$$

$$Z_a = \frac{Z_0}{\sin\frac{2\pi}{\lambda_1}L_a} \quad (6)$$

In the distributed constant circuit, by satisfying the equation (6), voltage/current characteristics equivalent to the line having a length which is one-fourth the wavelength corresponding to the first frequency are obtained with respect to the first frequency.

By satisfying the equation (5), the first capacitor and the second line resonate and the second capacitor and the third line resonate with respect to the second frequency. Therefore, the one end and the other end of the first line are short-circuited to the reference potential with respect to the second frequency.

Furthermore, by satisfying the equation (4), when one of the one end and the other end of the first line is short-circuited to the reference potential in an AC manner, the other of the one end and the other end of the first line enters an open state with respect to the first frequency.

In this case, the parameters of the first, second and third lines and the first and second capacitors are adjusted, thereby making it possible to shorten the first, second and third lines as well as to arbitrarily set the second frequency.

Consequently, there is provided a distributed constant circuit which has characteristics equivalent to a $\lambda/4$ line, can be miniaturized, and can suppress an arbitrary frequency.

Each of the first and second impedance elements may comprise an impedance device.

In this case, the parameters of the first and second impedance elements are adjusted in addition to the parameters of the first, second and third lines and the first and second capacitors, thereby making it possible to shorten the first, second and third lines as well as to arbitrarily set the second frequency.

Consequently, the distributed constant circuit can have characteristics equivalent to the λ/4 line, can be miniaturized, and can suppress an arbitrary frequency.

The first and second impedance elements may be shifts of the impedances from a 50 ohm system in a case where circuits connected to one end and the other end of the first line are respectively viewed from the one end and the other end.

In this case, even when the impedances in a case where the circuits connected to the one end and the other end of the first line are respectively viewed from the one end and the other end are shifted from the 50 ohm system, the distributed constant circuit can have characteristics equivalent to the A/4 line, can be miniaturized, and can suppress an arbitrary frequency.

A distributed constant circuit according to a further aspect of the present invention comprises a first line, a capacitor, a second line connected in series with the capacitor, and an impedance element, one end of the first line being connected to a predetermined reference potential in an AC manner, and the other end of the first line being connected to the reference potential through a series connection between the capacitor and the second line and connected to the reference potential through the impedance element, characteristics equivalent to a line having a length which is one-fourth a wavelength corresponding to a first frequency being obtained with respect to the first frequency, and the capacitor and the second line resonating with respect to a second frequency different from the first frequency.

In the distributed constant circuit, the characteristics equivalent to the line having a length which is one-fourth the wavelength corresponding to the first frequency are obtained with respect to the first frequency. Consequently, the other end of the first line enters an open state with respect to the first frequency.

The capacitor and the second line resonate with respect to the second frequency. Therefore, the other end of the first line is short-circuited to the reference potential with respect to the second frequency.

In this case, the parameters of the first and second lines and the capacitor are adjusted, thereby making it possible to shorten the first and second lines as well as to arbitrarily set the second frequency.

Consequently, there is provided a distributed constant circuit which has characteristics equivalent to a λ/4 line, can be miniaturized, and can suppress an arbitrary frequency.

It is preferable that the characteristic impedance $Z_a$ of the first line, the length $L_a$ of the first line, the characteristic impedance $Z_b$ of the second line, the length $L_b$ of the second line, the capacitance value C of the capacitor, the impedance $Z_c$ of the impedance element, a first frequency $f_1$, a wavelength $\lambda_1$ corresponding to the first frequency, a second frequency $f_2$, and a wavelength $\lambda_2$ corresponding to the second frequency satisfy relations expressed by equations (4), (5) and (6):

$$L_a = \frac{\lambda_1}{2\pi}\arctan\left\{\frac{\frac{jZ_c}{Z_a}\left(\frac{1}{j2\pi f_1 C} + jZ_b\tan\frac{2\pi}{\lambda_1}L_b\right)}{Z_c + \frac{1}{j2\pi f_1 C} + jZ_b\tan\frac{2\pi}{\lambda_1}L_b}\right\} \tag{4}$$

-continued $$L_b = \frac{\lambda 2}{2\pi}\arctan\frac{1}{C\cdot 2\pi f_2 Z_b} \tag{5}$$

$$Z_a = \frac{Z_0}{\sin\frac{2\pi}{\lambda_1}L_a} \tag{6}$$

In the distributed constant circuit, by satisfying the equation (6), voltage/current characteristics equivalent to the line having a length which is one-fourth the wavelength corresponding to the first frequency are obtained with respect to the first frequency.

By satisfying the equation (5), the capacitor and the second line resonate with respect to the second frequency. Therefore, the other end of the first line is short-circuited to the reference potential with respect to the second frequency.

Furthermore, by satisfying the equation (4), the other end of the first line enters an open state with respect to the first frequency.

In this case, the parameters of the first and second lines and the capacitor are adjusted, thereby making it possible to shorten the first and second lines as well as to arbitrarily set the second frequency.

Consequently, there is provided a distributed constant circuit which has characteristics equivalent to a λ/4 line, can be miniaturized, and can suppress an arbitrary frequency.

The impedance element may comprise an impedance device.

In this case, the parameter of the impedance element is adjusted in addition to the parameters of the first and second lines and the capacitor, thereby making it possible to shorten the first and second lines as well as to arbitrarily set the second frequency.

Consequently, the distributed constant circuit can have characteristics equivalent to the λ/4 line, can be miniaturized, and can suppress an arbitrary frequency.

The impedance element may be a shift of the impedance from a 50 ohm system in a case where a circuit connected to the other end of the first line is viewed from the other end.

In this case, even when the impedance in a case where the circuit connected to the other end of the first line is viewed from the other end is shifted from the 50 ohm system, the distributed constant circuit can have characteristics equivalent to the λ/4 line, can be miniaturized, and can suppress an arbitrary frequency.

The one end of the first line may be connected to a bias voltage, and the other end of the first line may be connected to an electrode of a transistor.

The first frequency may be the frequency of a fundamental wave, and the second frequency may be higher than the frequency of second harmonics relative to the fundamental wave.

A high-frequency circuit according to another aspect of the present invention comprises a transistor, a bias applying circuit for applying a DC bias to one electrode of the transistor, and a matching circuit for performing impedance matching between the electrode of the transistor and the other circuit, the bias applying circuit being constituted by any one of the above-mentioned distributed constant circuits, the matching circuit being provided between the bias applying circuit and the other circuit.

In the high-frequency circuit, the bias applying circuit is constituted by any one of the distributed constant circuits, thereby making it possible to transmit a signal having a first frequency between the electrode of the transistor and the other circuit while suppressing a second frequency and to apply a DC bias to the electrode of the transistor.

In this case, the matching circuit is provided between the bias applying circuit and the other circuit, so that frequency characteristics of a reflection coefficient at a node between the matching circuit and the other circuit have a wide peak directed downward at the first frequency. Consequently, wide band characteristics centered around the first frequency are obtained.

A high-frequency circuit according to still another aspect of the present invention comprises a transistor, a bias applying circuit for applying a DC bias to one electrode of the transistor, and a matching circuit for performing impedance matching between the electrode of the transistor and the other circuit, the bias applying circuit being constituted by any one of the above-mentioned distributed constant circuits, the matching circuit being provided between the electrode of the transistor and the bias applying circuit.

In the high-frequency circuit, the bias applying circuit is constituted by any one of the distributed constant circuits, thereby making it possible to transmit a signal having a first frequency between the electrode of the transistor and the other circuit while suppressing a second frequency and to apply a DC bias to the electrode of the transistor.

In this case, the matching circuit is provided between the electrode of the transistor and the bias applying circuit, so that frequency characteristics of a reflection coefficient at a node between the bias applying circuit and the other circuit have a narrow peak directed downward at the first frequency. Consequently, narrow band characteristics centered around the first frequency are obtained.

The high-frequency circuit may further comprise a harmonic removing circuit connected to the electrode of the transistor for removing a harmonic component relative to the first frequency.

In this case, it is possible to reliably remove the harmonic component relative to the first frequency while transmitting the first frequency between the electrode of the transistor and the other circuit.

A bias applying circuit according to another aspect of the present invention for bringing one electrode of a transistor into an open state with respect to the frequency of a fundamental wave and applying a DC bias to the electrode of the transistor comprises a resonance circuit connected between the electrode of the transistor and a predetermined reference potential, the resonance frequency of the resonance circuit being higher than the frequency of the second harmonics relative to the fundamental wave.

In the bias applying circuit, a DC bias is applied to the one electrode of the transistor, and the electrode of the transistor enters an open state with respect to the frequency of the fundamental wave. Further, the resonance circuit is connected between the electrode of the transistor and the reference potential, so that the electrode of the transistor enters a short-circuited state with respect to the resonance frequency of the resonance circuit. Consequently, the component of the resonance frequency of the resonance circuit is suppressed in the electrode of the transistor. Particularly, the resonance frequency of the resonance circuit is set to a frequency higher than the frequency of the second harmonics relative to the fundamental wave, so that losses are reduced in an AB-class operation of the transistor, thereby achieving high efficiency.

A bias applying circuit according to still another aspect of the present invention for applying a DC bias to one electrode of a transistor comprises any one of the above-mentioned distributed constant circuits, a first frequency being the frequency of a fundamental wave, a second frequency being higher than the frequency of second harmonics relative to the fundamental wave.

The bias applying circuit comprises any one of the distributed constant circuits, so that it is possible to transmit a signal having the first frequency between the electrode of the transistor and the other circuit while suppressing the component of the second frequency and to apply the DC bias to the electrode of the transistor.

In this case, the first frequency is the frequency of the fundamental wave, and the second frequency is set to a frequency higher than the frequency of the second harmonics relative to the fundamental wave, so that losses are reduced in an AB-class operation of the transistor, thereby achieving high efficiency. Consequently, there is provided a bias applying circuit which can be miniaturized and increased in efficiency.

An impedance adjusting method according to another aspect of the present invention comprises the step of changing the impedance of a resonance circuit in the above-mentioned bias applying circuit, to adjust a load impedance in second harmonics.

In the impedance adjusting method, it is possible to adjust the load impedance in the second harmonics by changing the impedance of the resonance circuit in the bias applying circuit. Consequently, it is possible to control the efficiency of a transistor.

An impedance adjusting method according to still another aspect of the present invention comprises the step of adjusting a load impedance in second harmonics on the basis of the product of a current and a voltage in an electrode in the above-mentioned bias applying circuit.

In the impedance adjusting method, it is possible to adjust the load impedance in the second harmonics on the basis of the product of a current and a voltage in the electrode in the bias applying circuit. Consequently, it is possible to control the efficiency of a transistor.

A distributed constant circuit according to another aspect of the present invention comprises a line and a capacitor, one end of the line being connected to a predetermined reference potential in an AC manner, and the other end of the line being connected to the reference potential through the capacitor, the line and the capacitor constituting an inductor with respect to a predetermined frequency.

In the distributed constant circuit, the capacitor and the short line constitute an inductor. Consequently, it is possible to miniaturize the circuit and lower the cost thereof.

It is preferable that the characteristic impedance $Z_a$ of the line, the length $L_a$ of the line, the capacitance value C of the capacitor, a wavelength $\lambda_1$ corresponding to the predetermined frequency, and an angular frequency $\omega_1$ corresponding to the predetermined frequency satisfy a relation expressed by an equation (7):

$$1 > \omega_1 C Z_a \tan\left(\frac{2\pi}{\lambda_1} L_a\right) \tag{7}$$

The distributed constant circuit functions as an inductor by satisfying the equation (7).

A distributed constant circuit according to still another aspect of the present invention comprises a line, a capacitor, and an inductor component connected in series with the capacitor, one end of the line being connected to a predetermined reference potential in an AC manner, and the other end of the line being connected to the reference potential through a series connection between the capacitor and the inductor component, the line, the capacitor and the inductor component constituting an inductor with respect to a first frequency.

In the distributed constant circuit, the capacitor, the inductor component and the short line constitute an inductor. Consequently, it is possible to miniaturize the circuit and lower the cost thereof.

It is preferable that the characteristic impedance $Z_a$ of the line, the length $L_a$ of the line, the capacitance value C of the capacitor, the inductance L of the inductor component, a wavelength $\lambda_1$ corresponding to the first frequency, and an angular frequency $\omega_1$ corresponding to the first frequency satisfy a relation expressed by an equation (8):

$$\frac{1}{\omega_1 C} > \omega_1 L + Z_a \tan\left(\frac{2\pi}{\lambda_1} L\right) \tag{8}$$

The distributed constant circuit functions as an inductor by satisfying the equation (8).

It is preferable that the capacitance value C of the capacitor, the inductance L of the inductor component, and an angular frequency $\omega_2$ corresponding to a second frequency satisfy a relation expressed by an equation (9):

$$\omega_2 L = \frac{1}{\omega_2 C} \tag{9}$$

In this case, by satisfying the equation (9), the other end of the line is short-circuited to the reference potential with respect to the second frequency. Therefore, it is possible to suppress the second frequency.

A distributed constant circuit according to a further aspect of the present invention comprises a first line, a capacitor, and a second line connected in series with the capacitor, one end of the line being connected to a predetermined reference potential in an AC manner, and the other end of the line being connected to the reference potential through a series connection between the capacitor and the second line, the first line, the capacitor and the second line constituting an inductor with respect to a first frequency.

In the distributed constant circuit, the capacitor and the short first and second lines constitute an inductor. Consequently, it is possible to miniaturize the circuit and lower the cost thereof.

It is preferable that the characteristic impedance $Z_a$ of the first line, the length $L_a$ of the first line, the characteristic impedance $Z_b$ of the second line, the length $L_b$ of the second line, the capacitance value C of the capacitor, a wavelength $\omega_1$ corresponding to the first frequency, and an angular frequency $\omega_1$ corresponding to the first frequency satisfy a relation expressed by an equation (10):

$$\frac{1}{\omega_1 C} > Z_b \tan\left(\frac{2\pi}{\lambda_1} L_b\right) + Z_a \tan\left(\frac{2\pi}{\lambda_1} L_a\right) \tag{10}$$

The distributed constant circuit functions as an inductor by satisfying the equation (10).

It is preferable that the characteristic impedance $Z_b$ of the second line, the length $L_b$ of the second line, the capacitance value C of the capacitor, a wavelength $\lambda_2$ corresponding to a second frequency, and the angular frequency $\omega_2$ corresponding to the second frequency satisfy a relation expressed by an equation (11):

$$\frac{1}{\omega_2 C} = Z_b \tan\left(\frac{2\pi}{\lambda_1} L_b\right) \tag{11}$$

In this case, by satisfying the equation (11), the other end of the first line is short-circuited to the reference potential with respect to the second frequency. Therefore, it is possible to suppress the second frequency.

The foregoing and other objects, features, aspects and advantages of the present invention will become more apparent from the following detailed description of the present invention when taken in conjunction with the accompanying drawings.

DESCRIPTION OF PREFERRED EMBODIMENTS

Figure 1:
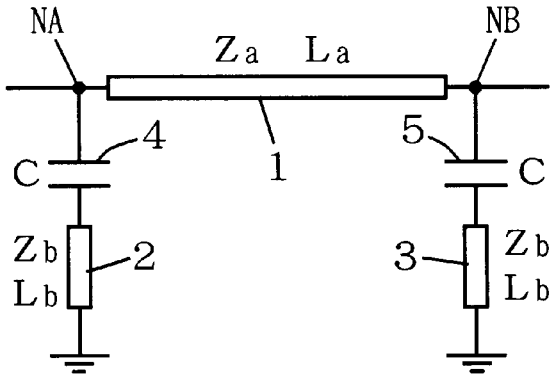
FIG. 1 is a circuit diagram showing a distributed constant circuit in one embodiment of the present invention.

FIG. 1 is a circuit diagram of a distributed constant circuit in one embodiment of the present invention.

In FIG. 1, a line 1 is connected between a node NA and a node NB. The node NA is grounded through a series connection between a capacitor 4 and a line 2, and the node NB is grounded through a series connection between a capacitor 5 and a line 3. Each of the lines 1, 2 and 3 is constituted by a microstrip line, for example. In the present embodiment, a ground potential corresponds to a reference potential.

$Z_a$ is the characteristic impedance of the line 1, $L_a$ is the length of the line 1, $Z_b$ is the characteristic impedance of the lines 2 and 3, and $L_b$ is the length of the lines 2 and 3. C is the capacitance value (capacitance) of the capacitors 4 and 5.

In the distributed constant circuit shown in FIG. 1, the characteristic impedances $Z_a$ and $Z_b$, the lengths $L_a$ and $L_b$, and the capacitance value C are set so as to satisfy the following equations (1), (2) and (3):

$$L_a = \frac{\lambda_1}{2\pi}\arctan\left\{\frac{1}{Z_a}\left(\frac{1}{2\pi f_1 C} - Z_b \tan\frac{2\pi}{\lambda_1}L_b\right)\right\} \tag{1}$$

$$L_b = \frac{\lambda_2}{2\pi}\arctan\frac{1}{C\cdot 2\pi f_2 Z_b} \tag{2}$$

$$Z_a = \frac{Z_0}{\sin\frac{2\pi}{\lambda_1}L_a} \tag{3}$$

In the foregoing equations (1), (2) and (3), $f_1$ is the frequency of a fundamental wave (a fundamental frequency), $f_2$ is a frequency to be suppressed, $\lambda_1$ is the wavelength of the fundamental wave, and $\lambda_2$ is a wavelength corresponding to the frequency to be suppressed. A method of driving the equations (1), (2) and (3) will be described later.

In the distributed constant circuit shown in FIG. 1, when the node NA is brought into a grounded state in an AC manner, the node NB enters an open state with respect to the fundamental frequency $f_1$, and enters a short-circuited state with respect to the frequency $f_2$. Consequently, it is possible to obtain characteristics equivalent to a λ/4 line while shortening the lines as well as to reduce gain at the arbitrary frequency $f_2$.

Frequency characteristics of $S_{11}$ and $S_{21}$ in the λ/4 line and the distributed constant circuit in the present embodiment were simulated. $S_{11}$ is an S parameter representing an input reflection coefficient, and $S_{21}$ is an S parameter representing gain.

Figure 2:
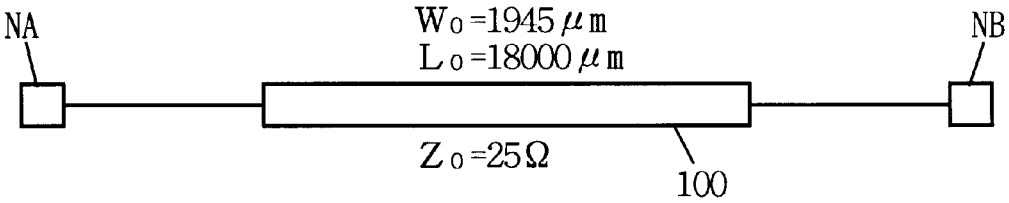
FIG. 2 is a diagram showing parameters in a $\lambda/4$ line.
Figure 3:
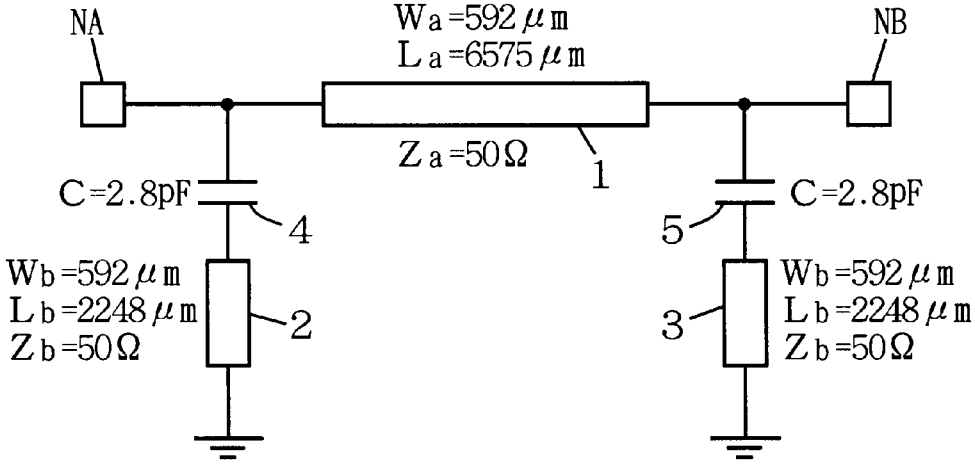
FIG. 3 is a diagram showing parameters in the distributed constant circuit in the embodiment.

FIG. 2 is a diagram showing parameters in the λ/4 line, and FIG. 3 is a diagram showing parameters in the distributed constant circuit in the embodiment. The fundamental frequency is 1.5 GHz.

As shown in FIG. 2, a λ/4 line 100 is connected between nodes NA and NB. The width $W_0$ of the A/4 line 100 is 1945 ‖m, the length Lo thereof is 18000 μm, and the characteristic impedance $Z_0$ thereof is 25Ω.

As shown in FIG. 3, the width $W_a$ of a line 1 is 592 μm, the length $L_a$ thereof is 6575 μm, and the characteristic impedance $Z_a$ thereof is 50Ω. The width $W_b$ of a line 2 is 592 μm, the length $L_b$ thereof is 2248 82 m, and the characteristic impedance $Z_b$ thereof is 50Ω. Similarly, the width $W_b$ of a line 3 is 592 μm, the length $L_b$ thereof is 2248 μm, and the characteristic impedance $Z_b$ thereof is 50Ω. The capacitance values C of capacitors 4 and 5 are respectively 2.8 pF.

Figure 4:
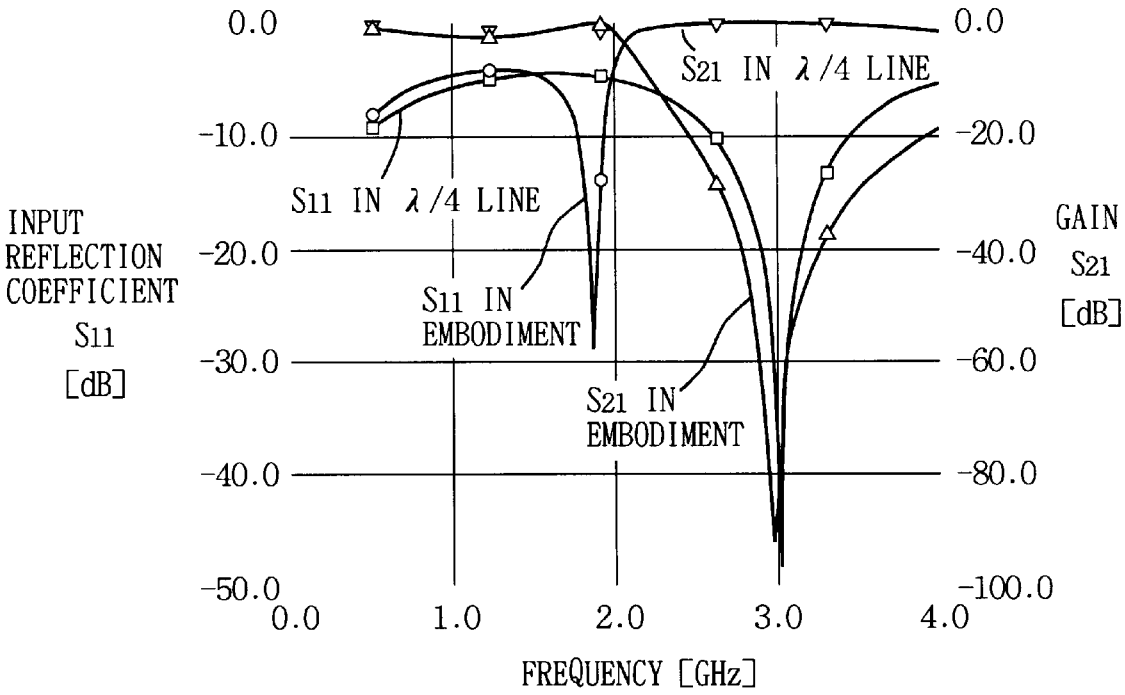
FIG. 4 is a diagram showing the results of simulation of frequency characteristics of $S_{11}$ and $S_{21}$ in the $\lambda/4$ line and the distributed constant circuit in the embodiment.

FIG. 4 is a diagram showing the results of the simulation of $S_{11}$ and $S_{21}$ between the nodes NA and NB in the λ/4 line 100 and the distributed constant circuit in the present embodiment. In FIG. 4, a square mark indicates $S_{11}$ in the λ/4 line 100, and a circular mark indicates $S_{11}$ in the distributed constant circuit in the embodiment, a downward triangular mark indicates $S_{21}$ in the λ/4 line 100, and an upward triangular mark indicates $S_{21}$ in the distributed constant circuit in the embodiment.

As shown in FIG. 4, $S_{11}$ (an input reflection coefficient) and $S_{21}$ (gain) in the distributed constant circuit in the embodiment and $S_{11}$ and $S_{12}$ in the λ/4 line 100 respectively coincide with each other at a fundamental frequency of 1.5 GHz. That is, it is found that the distributed constant circuit in the embodiment functions as the λ/4 circuit with respect to the fundamental wave while the lengths of the lines 1, 2 and 3 are being made smaller than those in the λ/4 line.

Figure 5:
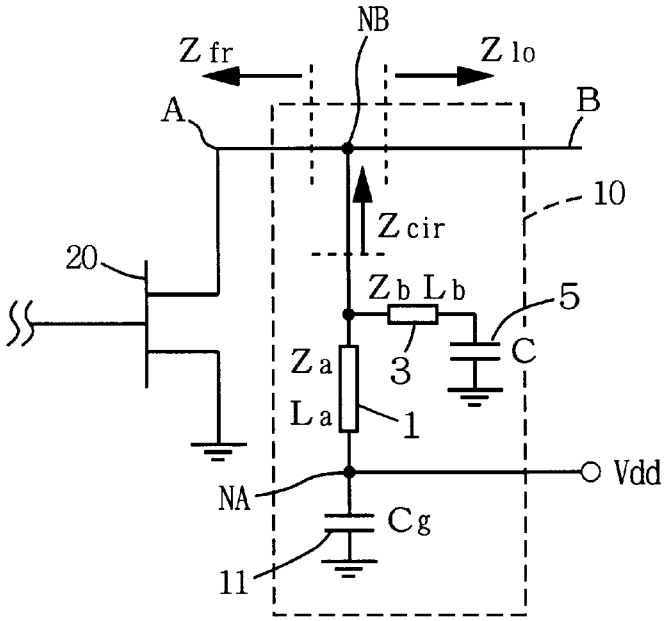
FIG. 5 is a circuit diagram of a bias applying circuit using the distributed constant circuit shown in FIG. 1.

FIG. 5 is a circuit diagram of a bias applying circuit to which the distributed constant circuit of FIG. 1 is operably linked. The bias applying circuit 10 shown in FIG. 5 functions as a drain bias applying circuit for applying a drain bias $V_{dd}$ to a FET 20.

In the bias applying circuit 10 shown in FIG. 5, a line 1 is connected between a node NA and a node NB, and the node NA is grounded through a capacitor 11. The drain bias $V_{dd}$ is applied to the node NA. The node NB is connected to the drain of the FET 20, and is grounded through a series connection between a line 3 and a capacitor 5.

$Z_{fr}$ is an impedance in a case where an input side (a terminal A) is viewed from the node NB (hereinafter referred to as an input-side impedance), and $Z_{10}$, is an impedance in a case where an output side (a terminal B) is viewed from the node NB (hereinafter referred to as an output-side impedance). $Z_{cir}$ is an impedance in a case where a circuit other than the distributed constant circuit is viewed from the node NB. The input-side impedance $Z_{fr}$ and the output-side impedance $Z_{10}$, are respectively taken as 50Ω.

Figure 38:
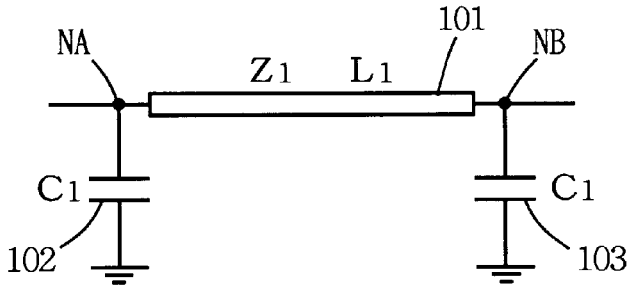
FIG. 38 PRIOR ART
FIG. 38 is a circuit diagram of a conventional distributed constant circuit equivalent to the λ/4 line shown in FIG. 37.
Figure 39:
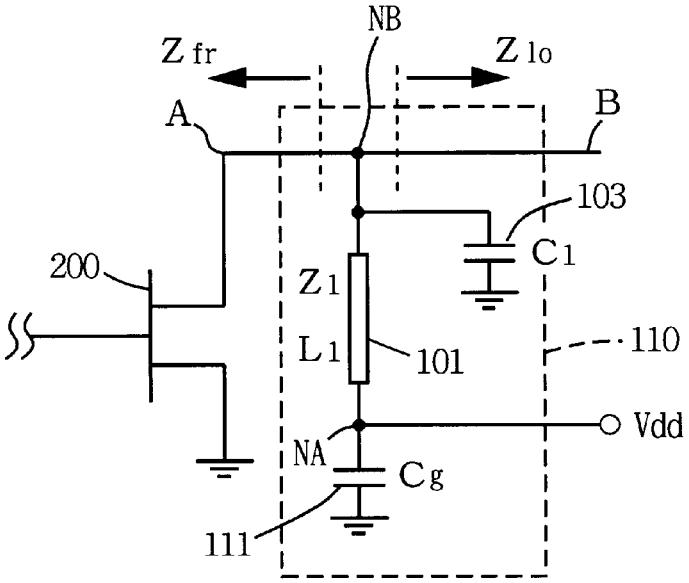
FIG. 39 PRIOR ART
FIG. 39 is a circuit diagram of a bias applying circuit using the distributed constant circuit shown in FIG. 38.

Frequency characteristics of $S_{11}$ and $S_{21}$ in a bias applying circuit in a comparative example 1 using the λ/4 line, a bias applying circuit in a comparative example 2 using the conventional distributed constant circuit shown in FIG. 38, and a bias applying circuit in the embodiment having a circuit arrangement of FIG. 5 have been simulated. In the simulation, a substrate composed of an alumina material having a thickness of 635 μm and having a dielectric constant of 10 has been used.

Figure 6:
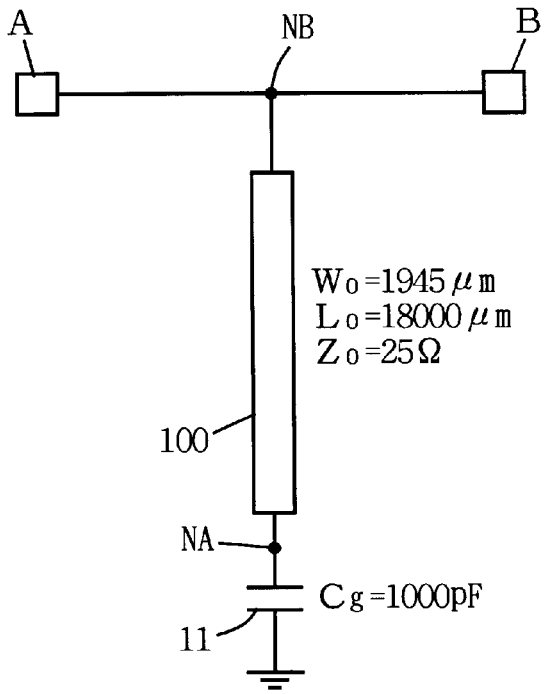
FIG. 6 is a diagram showing parameters in a bias applying circuit in a comparative example 1 using the A /4 line.

FIG. 6 is a diagram showing parameters in the bias applying circuit in the comparative example 1. In FIG. 6, a λ/4 line 100 is connected between a node NA and a node NB. The node NA is grounded through a capacitor 11, and the node NB is connected between terminals A and B.

The width $W_0$ of the λ/4 line 100 is 1945 μm, the length $L_0$ thereof is 18000 μm, and the characteristic impedance $Z_0$ thereof is 25Ω. The capacitance value $C_g$ of the capacitor 11 is 1000 pF.

Figure 7:
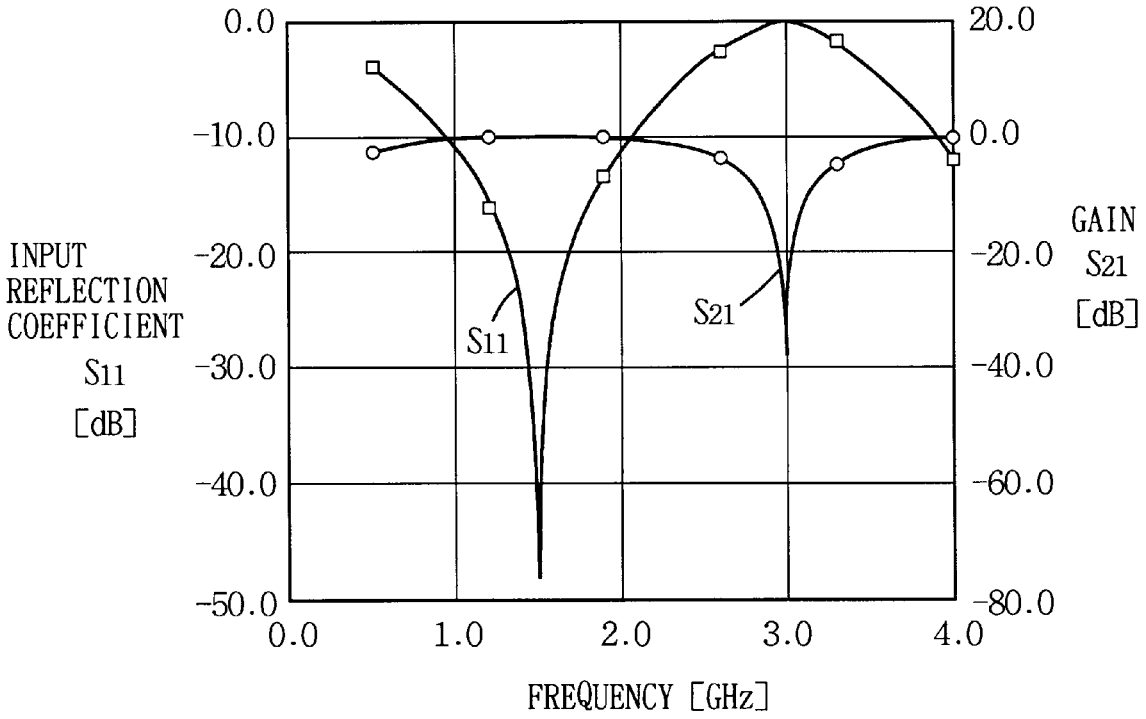
FIG. 7 is a diagram showing the results of simulation of frequency characteristics of $S_{11}$ and $S_{21}$ in the bias applying circuit shown in FIG. 6.

FIG. 7 is a diagram showing the results of the simulation of the frequency characteristics of $S_{11}$ and $S_{21}$ between the terminals A and B in the bias applying circuit shown in FIG. 6.

As shown in FIG. 7, in the bias applying circuit shown in FIG. 6. $S_{11}$ (an input reflection coefficient) is decreased at a fundamental frequency of 1.5 GHz, and $S_{21}$ (gain) is decreased at the second harmonic (3.0 GHz). That is, in the bias applying circuit shown in FIG. 6, it is found that the node NB is in an open state with respect to a fundamental wave, and is in a short-circuited state with respect to the second harmonic.

Figure 8:
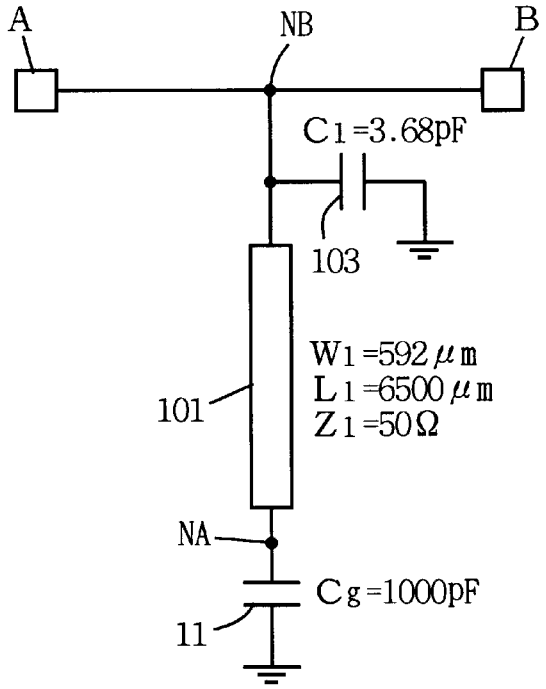
FIG. 8 is a diagram showing parameters in a bias applying circuit in a comparative example 2 using a distributed constant circuit shown in FIG. 38.

FIG. 8 is a diagram showing parameters in the bias applying circuit in the comparative example 2. In FIG. 8, a line 101 is connected between a node NA and a node NB. The node NA is grounded through a capacitor 11, and the node NB is grounded through a capacitor 103 and is connected between terminals A and B.

The width $W_1$ of the line 101 is 592 μm, the length $L_1$ thereof is 6500 μm, and the characteristic impedance $Z_1$ thereof is 50Ω. The capacitance value $C_1$ of the capacitor 103 is 3.68 pF, and the capacitance value $C_g$ of the capacitor 11 is 1000 pF. The length of a λ/4 line in a case where the characteristic impedance is 50Ω is 19500 μm, so that the length of the line 101 corresponds to λ/12.

Figure 9:
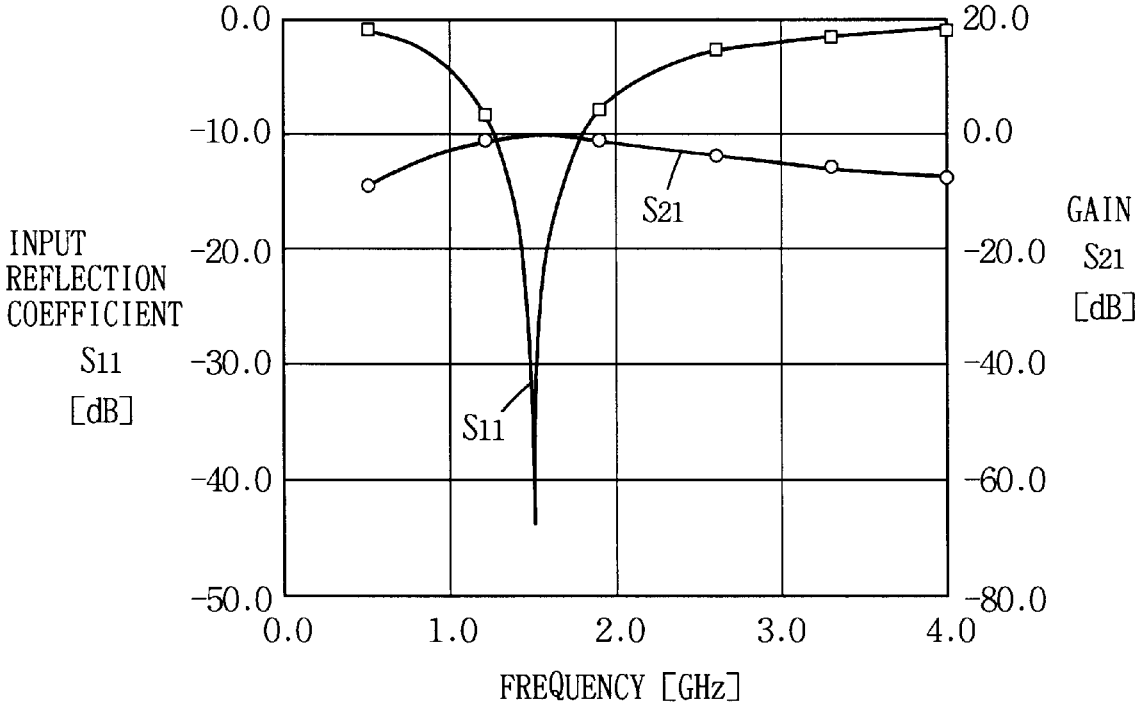
FIG. 9 is a diagram showing the results of simulation of frequency characteristics of $S_{11}$ and $S_{21}$ in the bias applying circuit shown in FIG. 8.

FIG. 9 is a diagram showing the results of the simulation of the frequency characteristics of $S_{11}$ and $S_{21}$ between the terminals A and B in the bias applying circuit shown in FIG. 8.

As shown in FIG. 9, in the bias applying circuit shown in FIG. 8, $S_{11}$ (an input reflection coefficient) is decreased at a fundamental frequency of 1.5 GHz, while $S_{21}$ (gain) is not decreased at the second harmonic (3.0 GHz). That is, in the bias applying circuit shown in FIG. 8, it is found that the node NB is in an open state with respect to a fundamental wave, while not being in a short-circuited state with respect to the second harmonic. Although the line can be shortened, therefore, the power-added efficiency of an amplifier cannot be improved.

Figure 10:
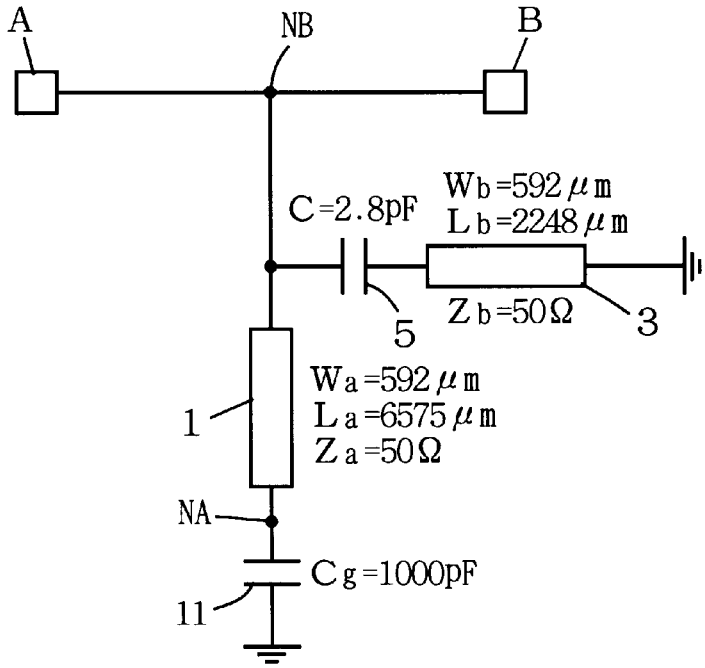
FIG. 10 is a diagram showing parameters in a bias applying circuit in an embodiment using the distributed constant circuit shown in FIG. 1.

FIG. 10 is a diagram showing parameters in the bias applying circuit in the embodiment. In FIG. 10, a line 1 is connected between a node NA and a node NB. The node NA is grounded through a capacitor 11, and the node NB is grounded through a series connection between a capacitor 5 and a line 3 and is connected between terminals A and B.

The width $W_a$ of the line 1 is 592 μm, the length $L_a$ thereof is 6575 μm, and the characteristic impedance $Z_a$ thereof is 50Ω. The width Wb of the line 3 is 592 μm, the length Lb thereof 2248 μm, and the characteristic impedance $Z_b$ thereof is 50Ω. The capacitance value C of the capacitor 5 is 2.8 pF, and the capacitance value $C_g$ of the capacitor 11 is 1000 pF.

Figure 11:
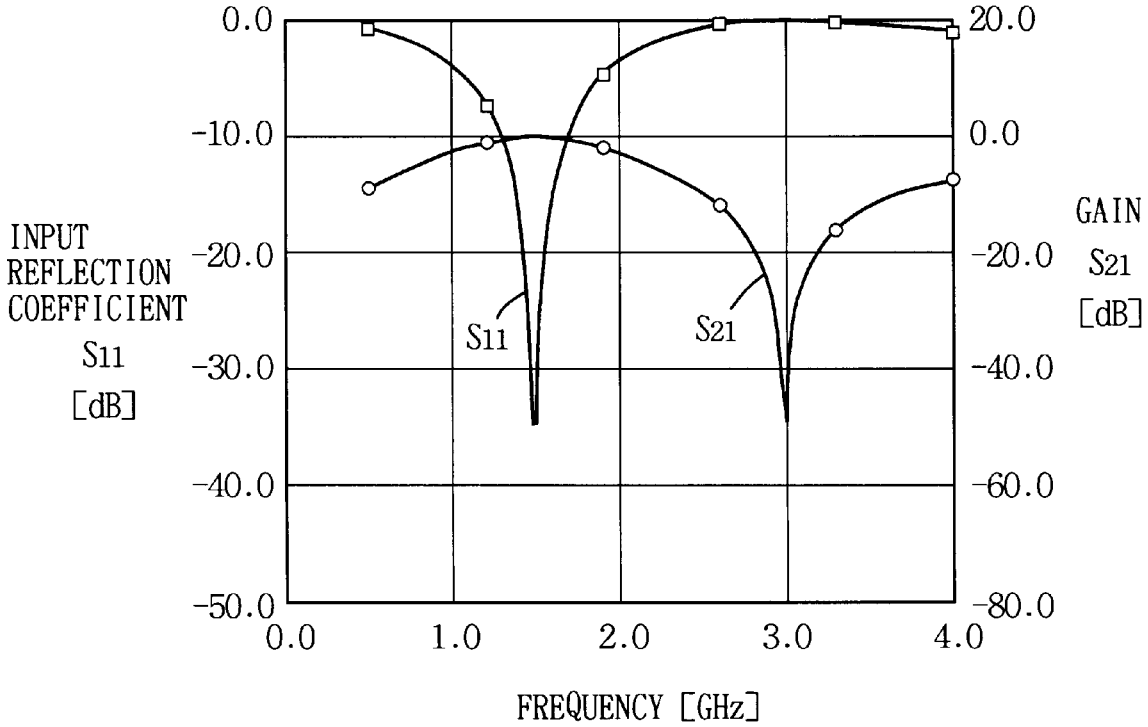
FIG. 11 is a diagram showing the results of simulation of frequency characteristics of $S_{11}$ and $S_{21}$ in the bias applying circuit shown in FIG. 10.

FIG. 11 is a diagram showing the results of the simulation of the frequency characteristics of $S_{11}$ and $S_{21}$ between the terminals A and B in the bias applying circuit shown in FIG. 10.

As shown in FIG. 11, in the bias applying circuit shown in FIG. 10, $S_{11}$ (an input reflection coefficient) is decreased at a fundamental frequency of 1.5 GHz, and $S_{21}$ (gain) is decreased at the second harmonic (3.0 GHz). That is, in the bias applying circuit shown in FIG. 10, it is found that the node NB is in an open state with respect to a fundamental wave, and is in a short-circuited state with respect to the second harmonic, so that characteristics close to those of the λ/4 line 100 are obtained. Consequently, it is possible to shorten the lines, and improve the power-added efficiency of an amplifier.

Figure 12:
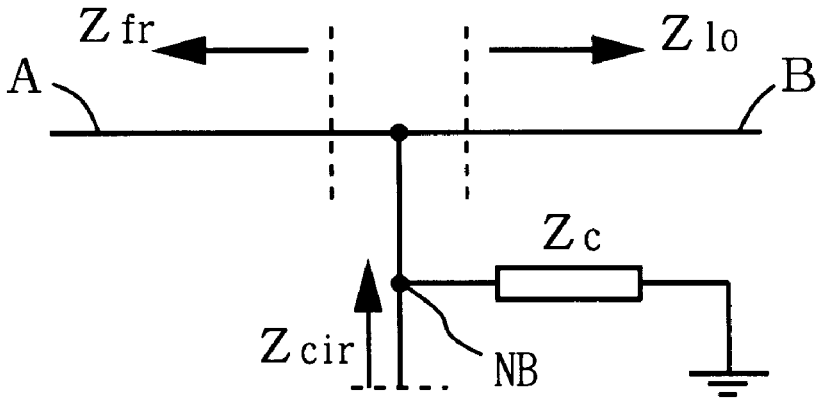
FIG. 12 is a diagram showing a circuit to be replaced when an input-side impedance and an output-side impedance are shifted from 50Ω.

Although in the bias applying circuit 10 shown in FIG. 5, the input-side impedance $Z_{fr}$ and the output-side impedance $Z_{10}$ are respectively taken as 50Ω, the input-side impedance $Z_{fr}$ and the output-side impedance $Z_{10}$ may be shifted from 50 Ω in the actual circuit. In this case, the impedance $Z_{cir}$ in a case where a circuit other than the distributed constant circuit is viewed from the node NB is replaced with that in a circuit arrangement of FIG. 12. In FIG. 12, an impedance $Z_c$ is connected to a node NB. The impedance $Z_c$ corresponds to shifts of the input-side impedance $Z_{fr}$ and the output-side impedance $Z_{10}$ from 50Ω.

The impedance $Z_c$ is found in the following manner. First, the impedance $Z_{cir}$ shown in FIG. 5 is found by measurement or calculation. It is then assumed that the input-side impedance $Z_{fr}$ and the output-side impedance $Z_{10}$ are respectively 50Ω. to find the impedance $Z_c$ such that an impedance $Z_{cir}$ shown in FIG. 12 is equal to the impedance $Z_{cir}$ shown in FIG. 5.

Figure 13:
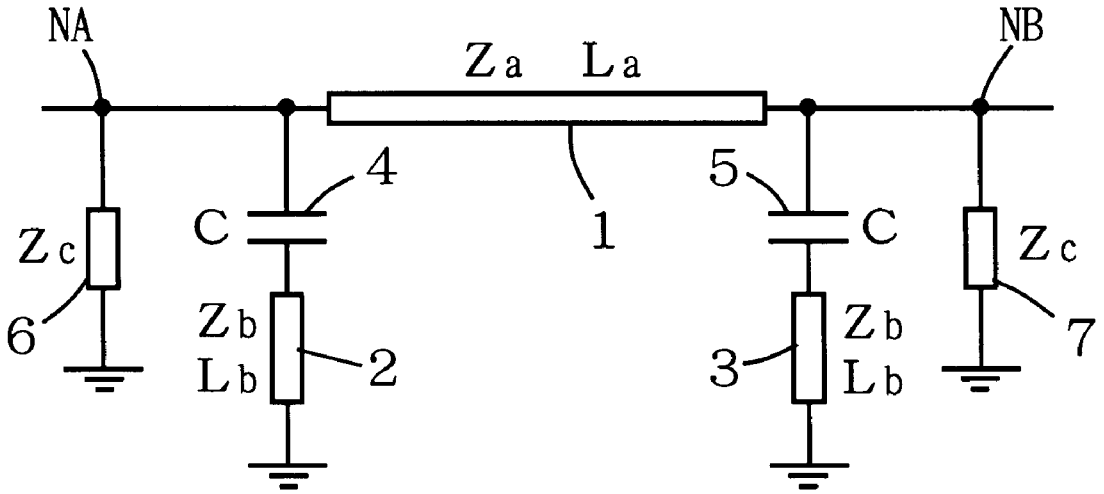
FIG. 13 is a circuit diagram of a distributed constant circuit considering shifts of the input-side impedance and the output-side impedance from 50Ω.

FIG. 13 is a circuit diagram of a distributed constant circuit equivalent to a λ/4 line in a case where the impedance $Z_c$ shown in FIG. 12 is considered.

In the distributed constant circuit shown in FIG. 13, impedance elements 6 and 7 each having an impedance $Z_c$ are further provided in the arrangement of the distributed constant circuit shown in FIG. 1. A node NA is grounded through the impedance element 6, and a node NB is grounded through the impedance element 7.

In the distributed constant circuit shown in FIG. 13, characteristic impedances $Z_a$ and $Z_b$, an impedance $Z_c$, lengths $L_a$ and $L_b$, and a capacitance value C are set so as to satisfy the following equations (4), (5) and (6):

$$L_a = \frac{\lambda_1}{2\pi}\arctan\left\{\frac{\frac{jZ_c}{Z_a}\left(\frac{1}{j2\pi f_1 C} + jZ_b\tan\frac{2\pi}{\lambda_1}L_b\right)}{Z_c + \frac{1}{j2\pi f_1 C} + jZ_b\tan\frac{2\pi}{\lambda_1}L_b}\right\} \tag{4}$$

$$L_b = \frac{\lambda 2}{2\pi}\arctan\frac{1}{C\cdot 2\pi f_2 Z_b} \tag{5}$$

$$Z_a = \frac{Z_0}{\sin\frac{2\pi}{\lambda_1}L_a} \tag{6}$$

In the foregoing equations (4), (5) and (6), $f_1$ is the frequency of a fundamental wave (a fundamental frequency), $f_2$ is a frequency to be suppressed, $\lambda_1$ is the wavelength of the fundamental wave, and $\lambda_2$ is a wavelength corresponding to the frequency to be suppressed. A method of deriving the equations (4), (5) and (6) will be described later.

In the distributed constant circuit shown in FIG. 13, when the node NA is grounded in an AC manner, the node NB enters an open state with respect to the fundamental frequency $f_1$, and enters a short-circuited state with respect to the frequency $f_2$to be suppressed. Consequently, it is possible to obtain characteristics equivalent to a λ/4 line while shortening the lines as well as to decrease gain at an arbitrary frequency $f_2$.

Figure 14:
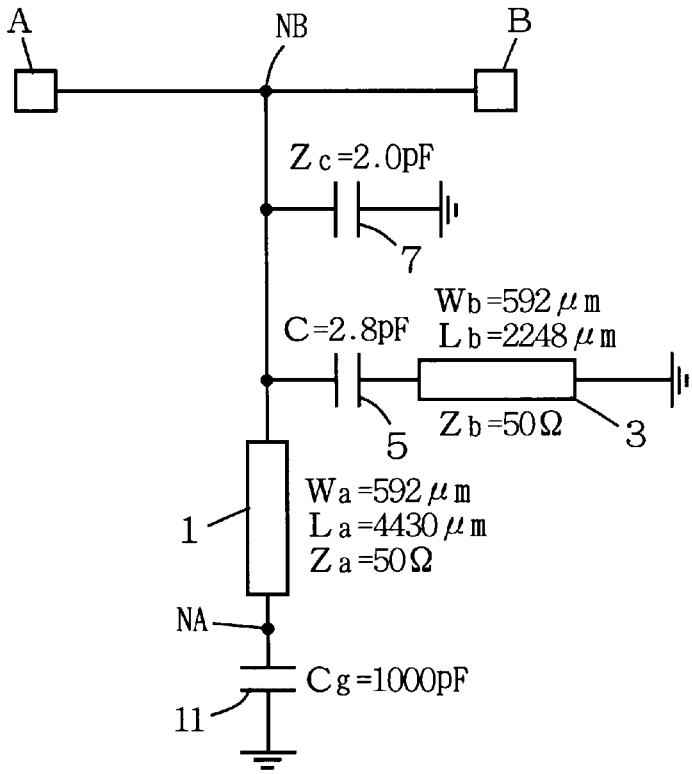
FIG. 14 is a circuit diagram of a bias applying circuit using the distributed constant circuit shown in FIG. 13.

FIG. 14 is a diagram showing parameters in a bias applying circuit using the distributed constant circuit shown in FIG. 13. In FIG. 14, a line 1 is connected between a node NA and a node NB. The node NA is grounded through a capacitor 11, and the node NB is grounded through a series connection between a line 5 and a capacitor 3, is grounded through an impedance element 7, and is connected between terminals A and B.

The width $W_a$ of the line 1 is 592 μm, the length $L_a$ thereof is 4430 μm, and the characteristic impedance $Z_a$ thereof is 50Ω. The width $W_b$ of the line 3 is 592μm, the length Lb thereof is 2248 82 m, and the characteristic impedance $Z_b$ thereof is 50 Q. The capacitance value C of the capacitor 5 is 2.8 pF, the capacitance value $C_g$ of the capacitor 11 is 1000 pF, and the impedance $Z_c$ of the impedance element 7 is 2.0 pF.

Figure 15:
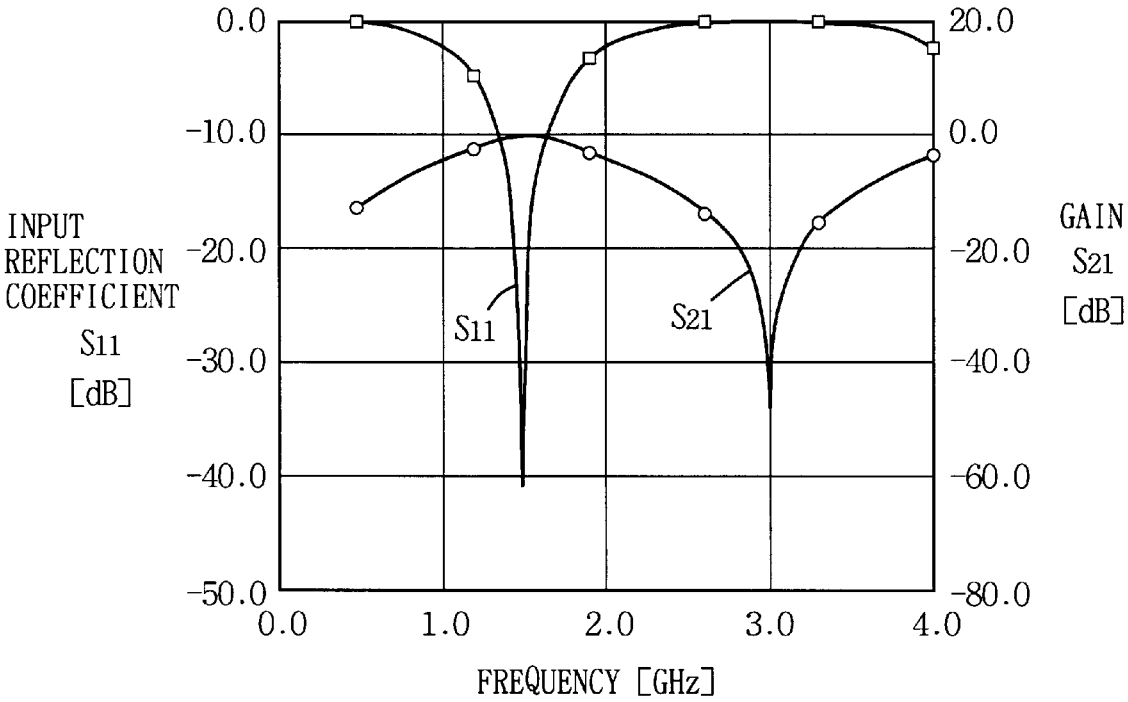
FIG. 15 is a diagram showing the results of simulation of frequency characteristics of $S_{11}$ and $S_{21}$ in the bias applying circuit shown in FIG. 14.

FIG. 15 is a diagram showing the results of the simulation of the frequency characteristics of $S_{11}$ and $S_{21}$ between the terminals A and B in the bias applying circuit shown in FIG. 14.

As shown in FIG. 15, in the bias applying circuit shown in FIG. 14, $S_{11}$ (a n input reflection coefficient) is decreased at a fundamental frequency of 1.5 GHz, and $S_{21}$ (gain) is decreased at the second harmonic (3.0 GHz). That is, in the bias applying circuit shown in FIG. 14, it is found that the node NB is in an open state with respect to the fundamental wave of 1.5 GHz, and is in a short-circuited state with respect to the second harmonic, so that characteristics closer to those of a λ/4 line are obtained.

Although in the above-mentioned example, description is made of a case where the impedance $Z_c$ corresponds to shifts of the input-side impedance $Z_{fr}$ and the output-side impedance $Z_{10}$ from 50Ω, an impedance device having an impedance $Z_c$ may be provided in a case where the input-side impedance $Z_{fr}$ and the output-side impedance $Z_{10}$ are 50Ω.

Although in the above-mentioned embodiment, the frequency $f_2$ to be suppressed is taken as the second harmonic (3.0 GHz), the frequency $f_2$ can be arbitrarily set if the parameters are set so as to satisfy the foregoing equation (2) or (5). Consequently, the distributed constant circuit shown in FIG. 1 or 13 functions as a λ/4 line having filter characteristics.

As described in the foregoing, in the distributed constant circuit according to the present embodiment, it is possible to miniaturize the circuit serving as the λ/4 line and to suppress an arbitrary frequency.

When the distributed constant circuit according to the present embodiment is used as a bias applying circuit, it is possible to miniaturize the bias applying circuit as well as to form a short-circuited state with respect to the second harmonic. Therefore, it is possible to fabricate a small-sized and highly efficient amplifier.

Furthermore, in the distributed constant circuit according to the present embodiment, frequency filter characteristics for decreasing gain at an arbitrary frequency $f_2$ are obtained. Consequently, it is possible to suppress frequencies other than a required frequency, thereby obtaining effects such as prevention of oscillation of a FET and the suppression of spurious.

The distributed constant circuit according to the present embodiment is applicable to various types of circuits such as an amplifier, a distributor, a synthesizer, a directional coupler, a mixer, and a filter.

Description is now made of a method of deriving the foregoing equations (1), (2) and (3).

The basic items of the distributed constant circuit will be described while referring to FIGS. 16 and 17 before the equations (1), (2) and (3) are derived.

Figure 16:
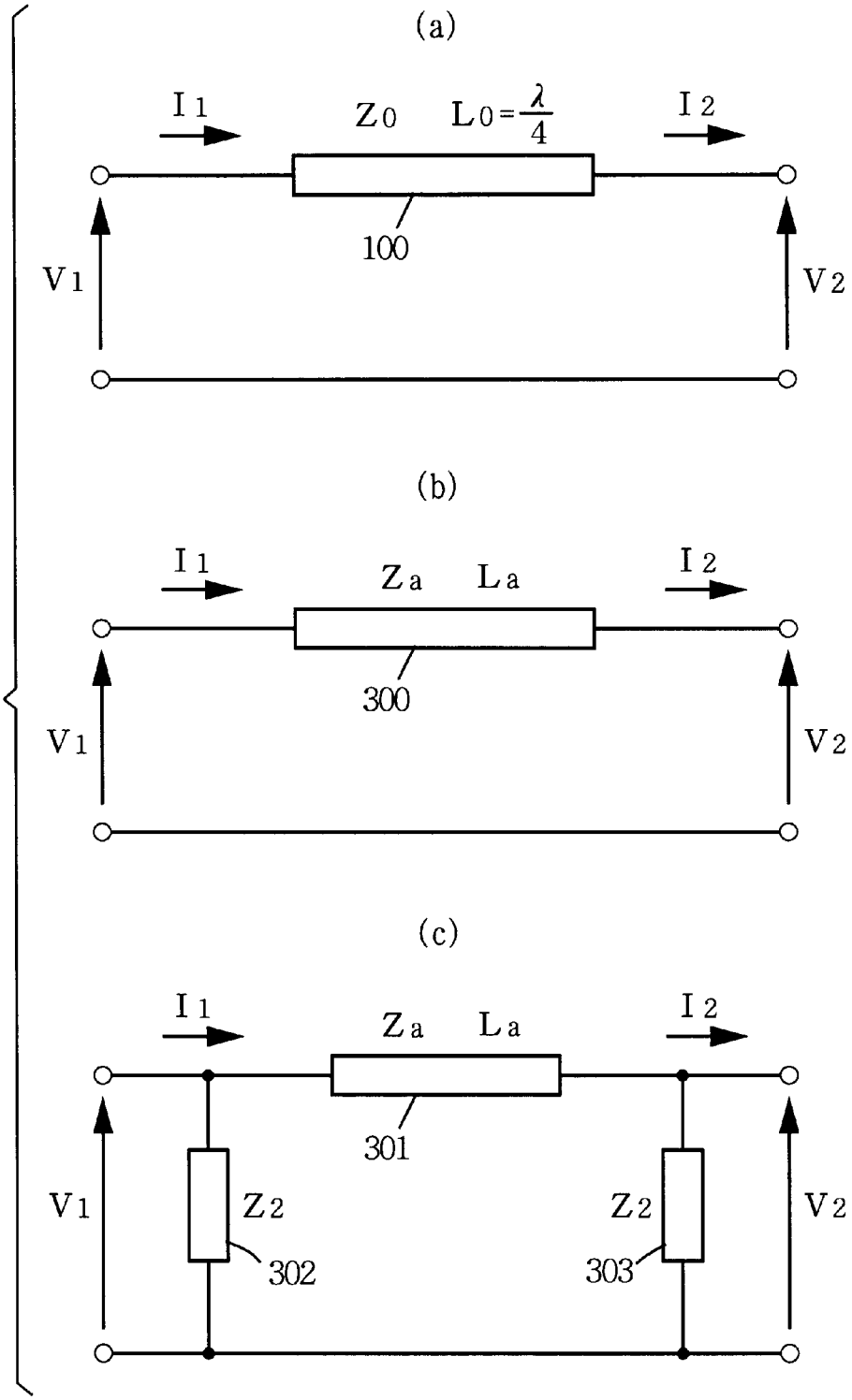
FIG. 16 is a diagram for explaining a method of calculating a relational expression of parameters in the distributed constant circuit shown in FIG. 1.

FIG. 16 (*a*) is a diagram showing the relation between a voltage and a current in a λ/4 line 100. In FIG. 16 (*a*), $Z_0$ is the characteristic impedance of the λ/4 line 100, and $L_0$ is the length of the λ/4 line 100. $V_1$ is an input voltage, $V_2$ is an output voltage, $I_1$ is an input current, and I2 is an output current. The relation between a voltage and a current in the λ/4 line 100 and a $[F_1]$ matrix are expressed by the following equation (A1):

$$\begin{bmatrix} V_1 \\ I_1 \end{bmatrix} = [F_1]\begin{bmatrix} V_2 \\ I_2 \end{bmatrix} \tag{A1}$$

$$[F_1] = \begin{bmatrix} 0 & jZ_0 \\ j\frac{1}{Z_0} & 0 \end{bmatrix}$$

FIG. 16 (*b*) is a diagram showing the relation between a voltage and a current in a line 300 having a characteristic impedance $Z_a$ and having a length $L_a$. The relation between 10 a voltage and a current in the line 300 shown in FIG. 16 (*b*) and a $[F_2]$ matrix are expressed by the following equation (A2):

$$\begin{bmatrix} V_1 \\ I_1 \end{bmatrix} = [F_2]\begin{bmatrix} V_2 \\ I_1 \end{bmatrix} \tag{A2}$$

$$[F_2] = \begin{bmatrix} \cos\frac{2\pi}{\lambda}L_a & jZ_a\sin\frac{2\pi}{\lambda}L_a \\ j\frac{1}{Z_a}\sin\frac{2\pi}{\lambda}L_a & \cos\frac{2\pi}{\lambda}L_a \end{bmatrix}$$

FIG. 16 (*c*) is a diagram showing the relation between a voltage and a current in a E-type circuit. In FIG. 16 (*c*), $Z_a$ is the characteristic impedance of a line 301, and $L_a$ is the length of the line 301. Further, $Z_2$ is the impedance of lines 302 and 303. The relation between a voltage and a current in the π-type circuit shown in FIG. 16 (*c*) and a $[F_3]$ matrix are expressed by the following equation (A3):

$$\begin{bmatrix} V_1 \\ I_1 \end{bmatrix} = [F_3]\begin{bmatrix} V_2 \\ I_2 \end{bmatrix} \tag{A3}$$

$$[F_3] = \begin{bmatrix} 1 & 0 \\ \frac{1}{Z_2} & 1 \end{bmatrix}[F_2]\begin{bmatrix} 1 & 0 \\ \frac{1}{Z_2} & 1 \end{bmatrix}$$

In order that the λ/4 line 100 shown in FIG. 16 (*a*) and the π-type circuit shown in FIG. 16 (*c*) are equivalent to each other, the relation of $[F_1]=[F_3]$ must be satisfied. The first row and the second column in the $[F_3]$ matrix is $jZ_a\sin(2\pi/\lambda)L_a$, and the first row and the second column in the $[F_1]$ matrix is $jZ_0$. Consequently the following equation (A4) holds:

$$jZ_a\sin\frac{2\pi}{\lambda}L_a = jZ_0 \tag{A4}$$

Figure 17:
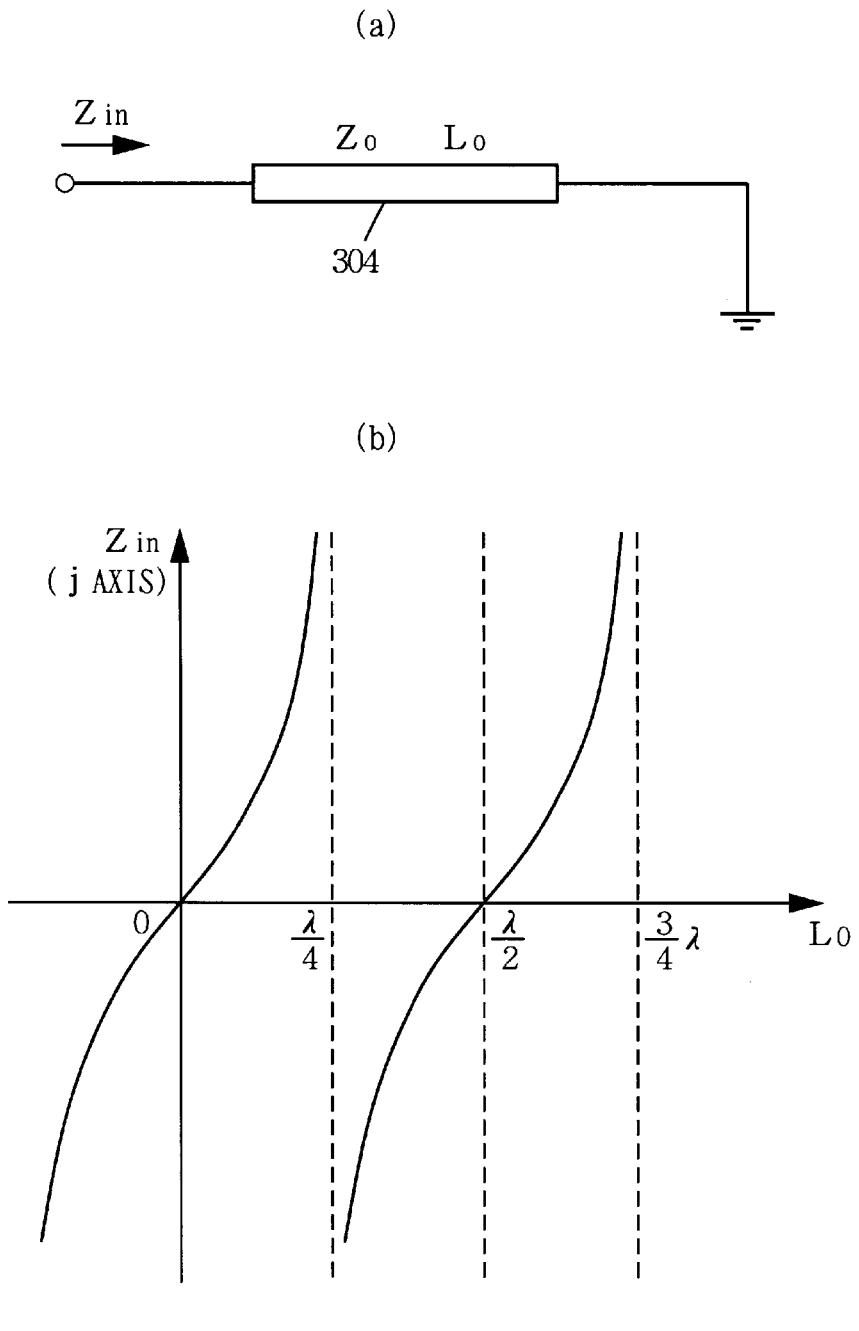
FIG. 17 is a diagram for explaining a method of calculating a relational expression of parameters in the distributed constant circuit shown in FIG. 1.

FIG. 17 (*a*) is a diagram showing a line 304 having its output terminal short-circuited to a ground potential. In FIG. 17 (*a*), $Z_0$ is the characteristic impedance of the line 304, and $L_o$ is the length of the line 304. The input impedance $Z_{in}$ of the line 304 is expressed by the following equation (A5):

$$Z_{in} = jZ_0\tan\frac{2\pi}{\lambda}L_0 \tag{A5}$$

FIG. 17 (*b*) is a diagram showing the relation between the length $L_o$ of the line 304 and an input impedance $Z_{in}$ shown in FIG. 17 (*a*). As shown in FIG. 17 (*b*), in the range of $0<L_o<\lambda/4$, for example, the input impedance $Z_{in}$ is positive, so that the line 304 functions as an inductor. In this case, the impedance $Z_L$ of the inductor is jωL.

Figure 18:
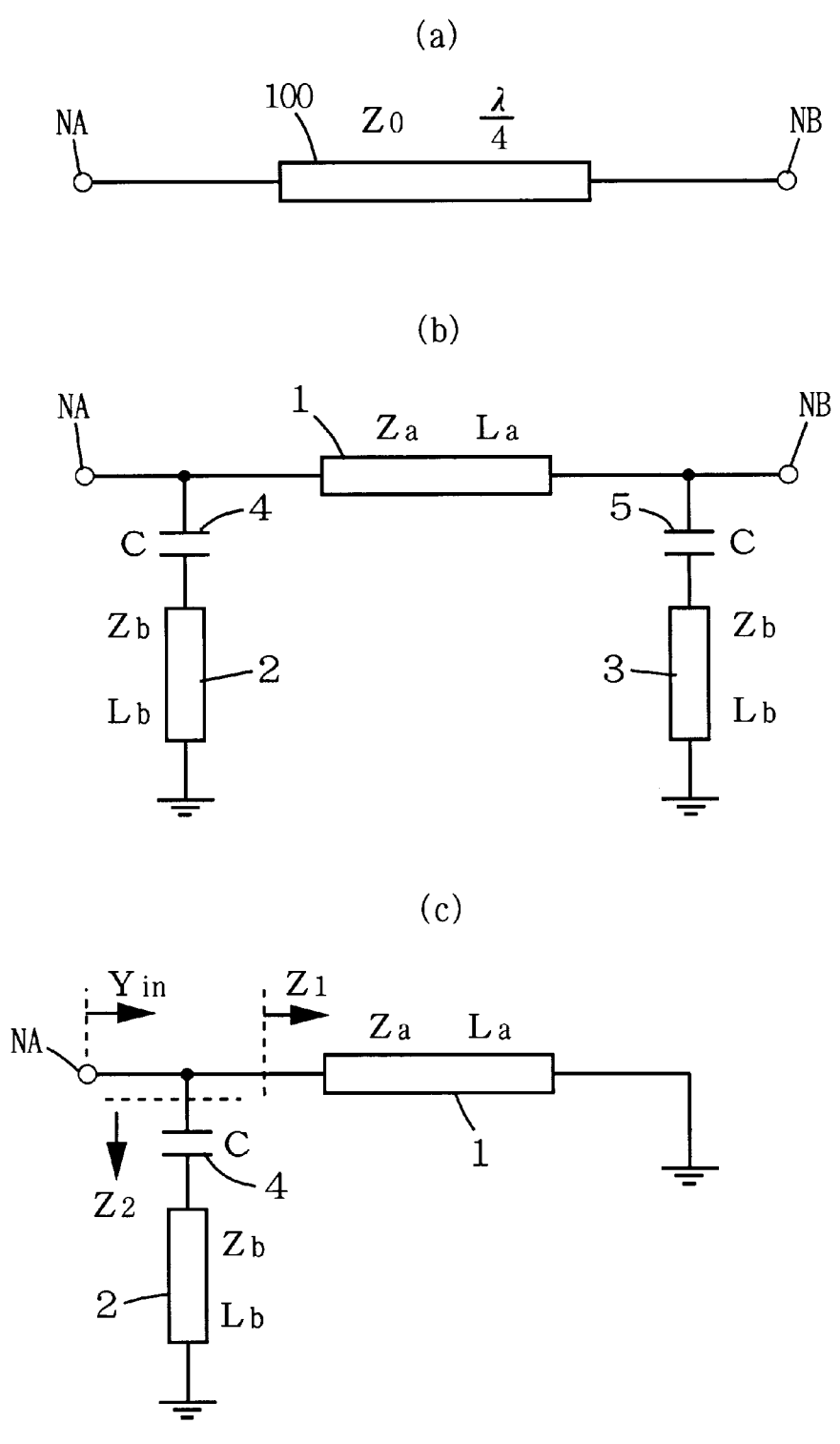
FIG. 18 is a diagram for explaining a method of calculating a relational expression of parameters in the distributed constant circuit shown in FIG. 1.
Figure 19:
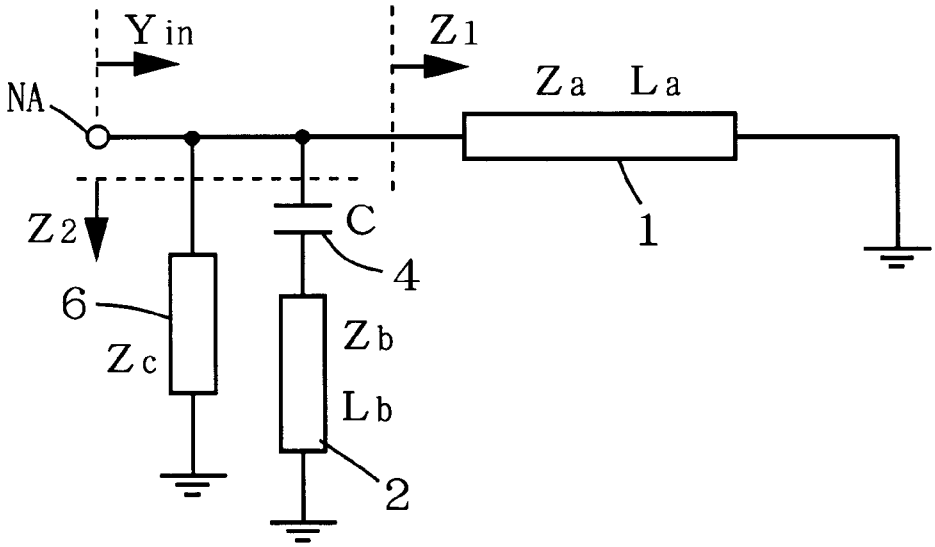
FIG. 19 is a diagram for explaining a method of calculating a relational expression of parameters in the distributed constant circuit shown in FIG. 13.

Referring to FIGS. 18 and 19, the foregoing equations (1), (2), and (3) will be derived.

① Derivation of equation (3)

A λ/4 line 100 shown in FIG. 18 (*a*) and a distributed constant circuit shown in FIG. 18 (b) shall be equivalent to each other at a fundamental frequency. Let $f_1$ be a fundamental frequency, and A be a wavelength corresponding to the fundamental frequency $f_1$.

In FIG. 18 (*a*), the following equation (B1) holds from the foregoing equation (A1):

$$V_1 = j\,Z_0 I_2 \tag{B1}$$

In FIG. 18 (*b*), the following equation (B2) holds from the foregoing equation (A4):

$$V_1 = jZ_a\sin\frac{2\pi}{\lambda_1}L_a I_2 \tag{B2}$$

The following equation (B3) holds from the equations (B1) and (B2):

$$jZ_0 I_2 = jZ_a\sin\frac{2\pi}{\lambda_1}L_a I_2 \tag{B3}$$

The following equation (B4) is derived from the equation (B3):

$$Z_a = \frac{Z_0}{\sin\frac{2\pi}{\lambda_1}L_a} \tag{B4}$$

The equation (B4) corresponds to the equation (3).

② Derivation of Equation (2)

In order that the distributed constant circuit shown in FIG. 18 (*b*) enters a short-circuited state with respect to a frequency $f_2$ (a wavelength $\lambda_2$), capacitors 4 and 5 and lines 2 and 3 may respectively resonate. Letting L be an inductor component which resonates with a capacitance value C, the following equation (B5) holds:

$$2\pi f_2 = \frac{1}{\sqrt{LC}} \tag{B5}$$

The following equation (B6) is obtained from the 15 equation (B5):

$$L = \frac{1}{C\cdot 4\pi^2 f_2^2} \tag{B6}$$

Since the impedance of the lines 2 and 3 is $jZ_b\tan(2\pi/\lambda_2)L_b$, the following equation (B7) holds from the relation shown in FIG. 17:

$$j\omega_2 L = jZ_b\tan\frac{2\pi}{\lambda_2}L_b \tag{B7}$$

where $\omega_2$ is an angular velocity corresponding to the frequency $f_2$.

When the equation (B6) is substituted into the equation (B7), the following equation (B8) is obtained:

$$j2\pi f_2\cdot\frac{1}{C\cdot 4\pi^2 f_2^2} = jZ_b\tan\frac{2\pi}{\lambda_2}L_b \tag{B8}$$

When the equation (B8) is deformed, the following equation (B9) is obtained:

$$L_b = \frac{\lambda_2}{2\pi}\arctan\frac{1}{C\cdot 2\pi f_2 Z_b} \tag{B9}$$

The equation (B9) corresponds to the equation (2).

③ Derivation of equation (1)

In order that the distributed constant circuit shown in FIG. 18 (*b*) is equivalent to the λ/4 line 100 shown in FIG. 18 (*a*), when one end is short-circuited to a ground potential, the other end must enter an open state with respect to the fundamental frequency $f_1$, as shown in FIG. 18 (*c*).

In FIG. 18 (*c*), an impedance $Z_1$ in a case where the line 1 is viewed from a node NA is expressed by the following equation (B10):

$$Z_1 = jZ_a \tan\frac{2\pi}{\lambda_1}L_b \tag{B10}$$

An impedance $Z_2$ in a case where a capacitor 4 and a line 2 are viewed from the node NA is expressed by the following equation (B11):

$$Z_2 = \frac{1}{j\omega_1 C} + jZ_a \tan\frac{2\pi}{\lambda_1}L_b \tag{B11}$$

An admittance $Y_{in}$ in a case where the whole of the distributed constant circuit is viewed from the node NA is expressed by the following equation (B12):

$$Y_{in} = \frac{1}{Z_1} + \frac{1}{Z_2} = \frac{Z_1 + Z_2}{Z_1 Z_2} \tag{B12}$$

In order that the node NA enters an open state, $Y_{in}$ must be zero. Accordingly, the following equation (B13) holds:

$$Z_1 + Z_2 = 0 \tag{B13}$$

When the equations (B10) and (B11) are substituted into the equation (B13), the following equation (B14) is obtained:

$$jZ_a \tan\frac{2\pi}{\lambda_1}L_a + \frac{1}{j\omega_1 C} + jZ_b \tan\frac{2\pi}{\lambda_1}L_b = 0 \tag{B14}$$

When the equation (B14) is deformed, the following equation (B15) is obtained:

$$L_a = \frac{\lambda_1}{2\pi}\arctan\left\{\frac{1}{Z_a}\left(\frac{1}{2\pi f_1 C} - Z_b \tan\frac{2\pi}{\lambda_1}L_b\right)\right\} \tag{B15}$$

The equation (B15) corresponds to the equation (1).

④ Derivation of equation (6)

The equation (6) is derived in the same manner as the foregoing item ①.

⑤ Derivation of equation (5)

The equation (5) is derived in the same manner as the foregoing item ②.

⑥ Derivation of equation (4)

The equation (4) is derived in the same manner as the foregoing item ③. As shown in FIG. 19, when one end is short-circuited to a ground potential, the other end must enter an open state with respect to the fundamental frequency In FIG. 19, a n impedance $Z_1$ in a case where a line 1 is viewed from a node NA is expressed by the following equation (C1):

$$Z_1 = jZ_a \tan\frac{2\pi}{\lambda}L_a \tag{C1}$$

An impedance $Z_2$ in a case where a capacitor 4 and a line 2 are viewed from the node NA is expressed by the following equation (C2):

$$Z_2 = \frac{Z_c\left(\frac{1}{j\omega_1 C} + jZ_b \tan\frac{2\pi}{\lambda_1}L_b\right)}{Z_c + \frac{1}{j\omega_1 C} + jZ_b \tan\frac{2\pi}{\lambda_1}L_b} \tag{C2}$$

An admittance $Y_{in}$ in a case where the whole of the distributed constant circuit is viewed from the node NA is expressed by the following equation (C3):

$$Y_{in} = \frac{1}{Z_1} + \frac{1}{Z_2} = \frac{Z_1 + Z_2}{Z_1 Z_2} \tag{C3}$$

In order that the node NA enters an open state, $Y_{in}$ Must be zero. Accordingly, the following equation (C4) holds:

$$Z_1 + Z_2 = 0 \tag{C4}$$

When the equations (C1) and (C2) are substituted into the equation (C4), the following equation (C5) is obtained:

$$jZ_a \tan = \frac{2\pi}{\lambda}L_a + \frac{Z_c\left(\frac{1}{j\omega_1 C} + jZ_b \tan\frac{2\pi}{\lambda_1}L_b\right)}{Z_c + \frac{1}{j\omega_1 C} + jZ_b \tan\frac{2\pi}{\lambda_1}L_b} = 0 \tag{C5}$$

When the equation (C5) is deformed, the following equation (C6) is obtained:

$$L_a = \frac{\lambda_1}{2\pi}\arctan\left\{\frac{\frac{jZ_c}{Z_a}\left(\frac{1}{j\omega_1 C} + jZ_b \tan\frac{2\pi}{\lambda_1}L_b\right)}{Z_c + \frac{1}{j\omega_1 C} + jZ_b \tan\frac{2\pi}{\lambda_1}L_b}\right\} \tag{C6}$$

Figure 20:
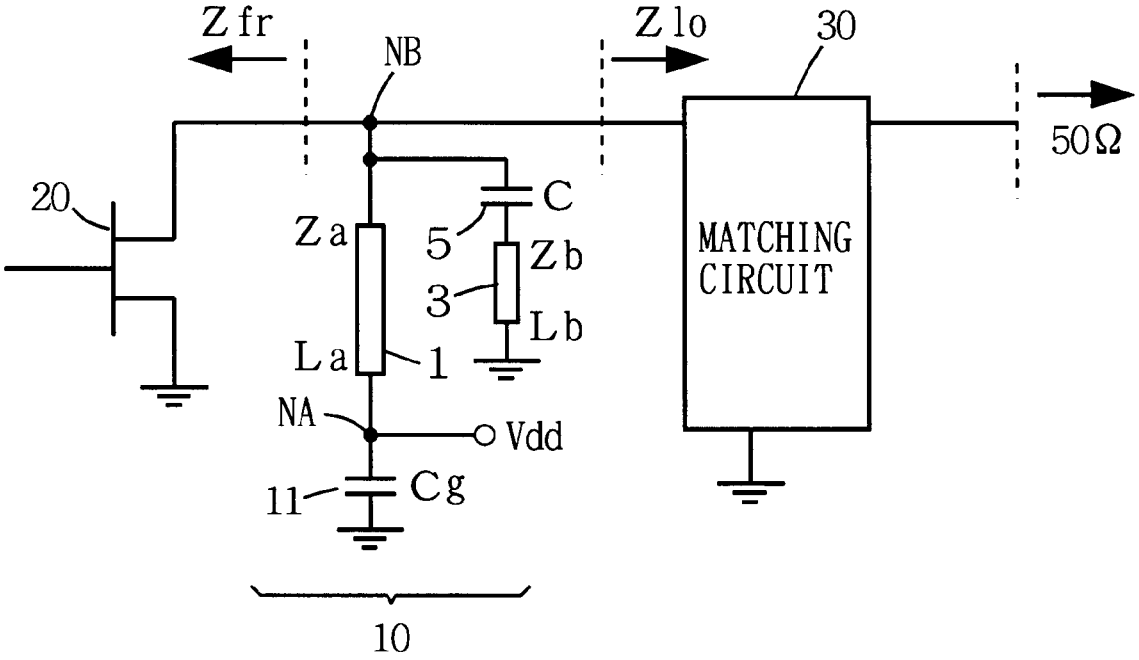
FIG. 20 is a circuit diagram showing one example of a high-frequency circuit including the bias applying circuit shown in FIG. 5.

The equation (C6) corresponds to the equation (4). FIG. 20 is a circuit diagram showing a first example of a high-frequency circuit including a bias applying circuit using the distributed constant circuit shown in FIG. 5. In the high-frequency circuit shown in FIG. 20, a matching circuit 30 is connected to the drain of a FET 20. A bias applying circuit 10 is connected to a node NB between the drain of the FET 20 and the matching circuit 30. Another circuit (not shown) is connected to a stage succeeding the matching circuit 30.

In the high-frequency circuit shown in FIG. 20, the bias applying circuit 10 enters an open state with respect to a fundamental wave, so that the bias applying circuit 10 can be designed independently of the matching circuit 30. Consequently, the bias applying circuit 10 and the matching circuit 30 can be independently adjusted.

The bias applying circuit 10 can be also designed by a 50 ohm system, or can be designed in consideration of the capacitance value of the FET 20.

When the bias applying circuit 10 is designed by the 50 ohm system, the design becomes easy. In this case, even when the FET 20 performs a large signal operation, the bias applying circuit 10 can be kept in an open state with respect to the fundamental wave. Consequently, the designing method is applicable to a high-frequency circuit performing a large signal operation.

When the bias applying circuit 10 is designed in consideration of the capacitance value of the FET 20, the length of the line 1 can be reduced. In this case, when the FET 20 performs a large signal operation, the capacitance value of the FET 20 varies, so that the bias applying circuit 10 cannot, in some cases, be kept in an open state with respect to the fundamental wave. Consequently, the designing method is applicable to a high-frequency circuit performing a small signal operation.

Figure 21:
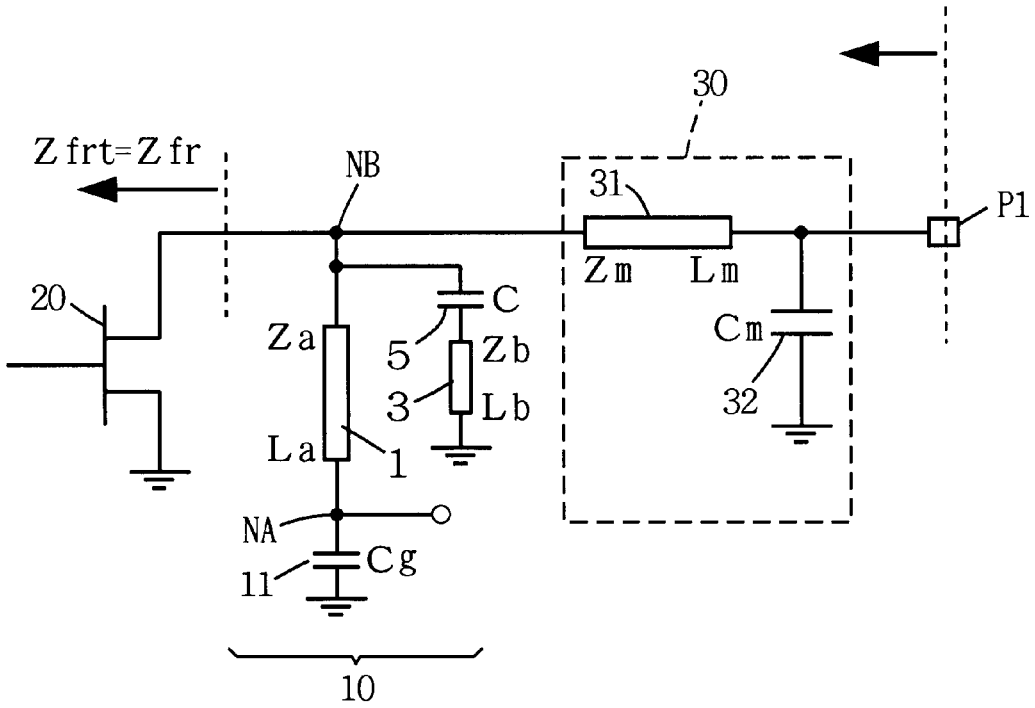
FIG. 21 is a circuit diagram showing a specific example of a matching circuit in the high-frequency circuit shown in FIG. 20.

FIG. 21 is a circuit diagram showing a specific example of a matching circuit in the high-frequency circuit shown in FIG. 20. In FIG. 21, a matching circuit 30 comprises a line 31 and a capacitor 32. The line 31 is connected between a node NB and a port P1, and the capacitor 32 is connected between the port P1 and a ground potential.

Figure 22:
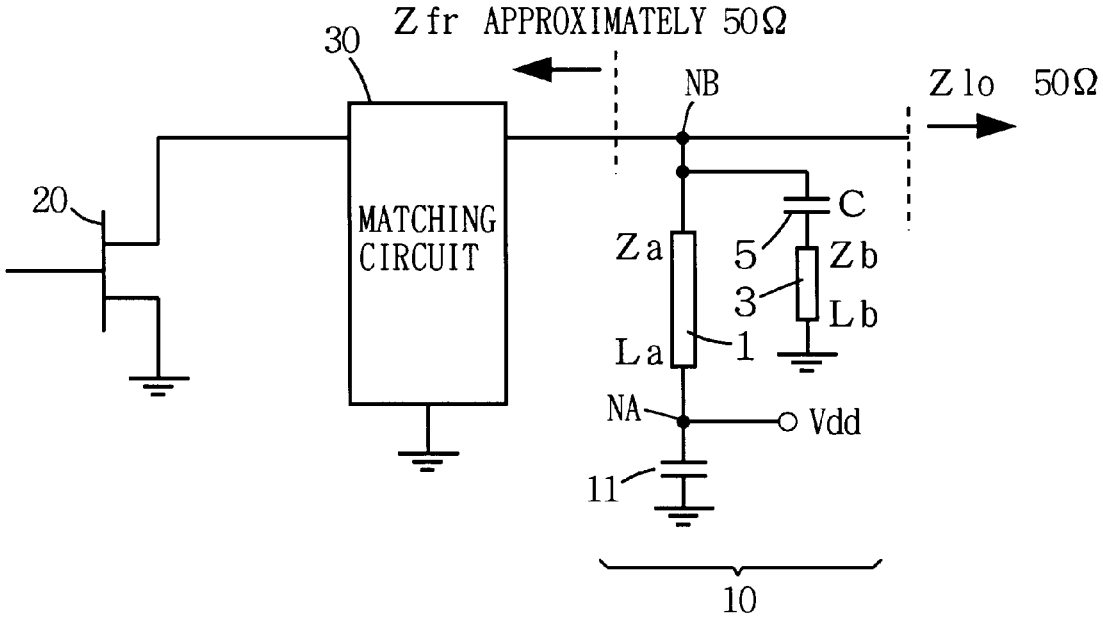
FIG. 22 is a circuit diagram showing another example of a high-frequency circuit including the bias applying circuit shown in FIG. 5.

FIG. 22 is a circuit diagram showing a second example of a high-frequency circuit including a bias applying circuit using the distributed constant circuit shown in FIG. 5. In the high-frequency circuit shown in FIG. 22, a matching circuit 30 is connected between the drain of a FET 20 and a node NB, and a bias applying circuit 10 is connected to the node NB. Another circuit (not shown) in a stage succeeding the matching circuit 30 is connected to the node NB.

In the high-frequency circuit shown in FIG. 22, the bias applying circuit 10 enters an open state with respect to a fundamental wave, so that the bias applying circuit 10 can be designed independently of the matching circuit 30.

Consequently, the bias applying circuit 10 and the matching circuit 30 can be independently adjusted.

Since an input-side impedance $Z_{fr}$ in a case where the FET 20 is viewed from the node NB is approximately 50Ω, and an output-side impedance $Z_{lo}$ in a case where the other circuit connected to the node NB is viewed from the node NB is 50Ω, the bias applying circuit 10 can be designed by a 50 ohm system. Consequently, the bias applying circuit 10 can be easily designed.

Furthermore, the matching circuit 30 is provided between the drain of the FET 20and the bias applying circuit 10. Even when the capacitance value of the FET 20 varies by a large signal operation of the FET 20, therefore, the bias applying circuit 10 is not easily affected by the variation in the capacitance value.

Figure 23:
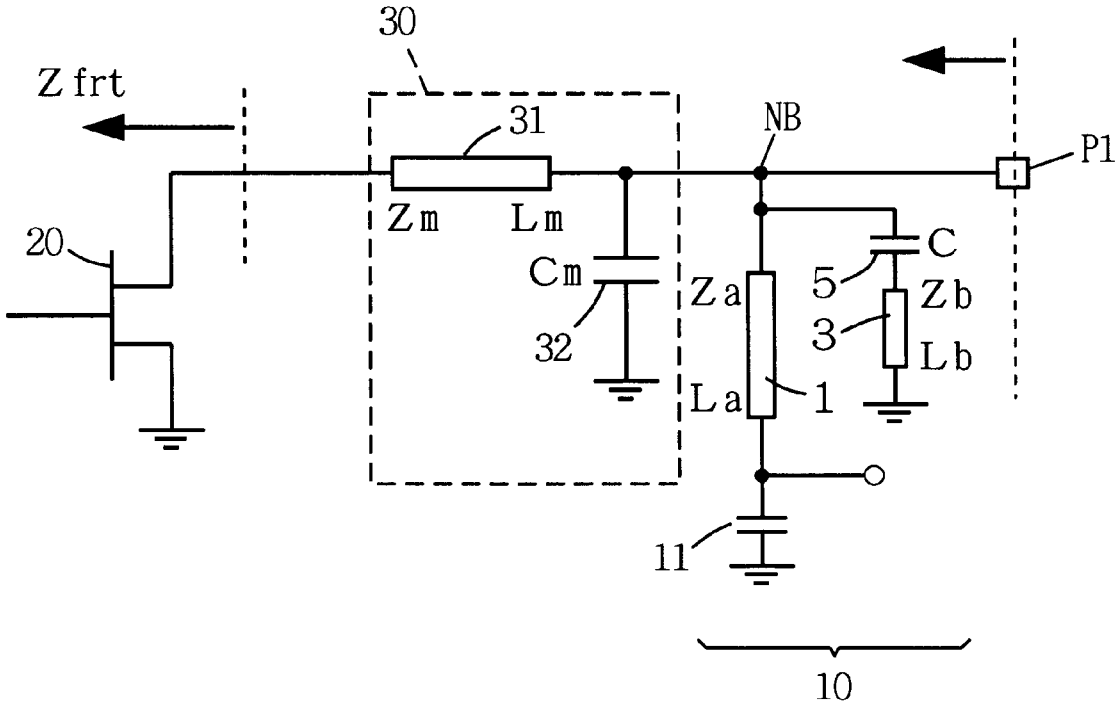
FIG. 23 is a circuit diagram showing a specific example of a matching circuit in the high-frequency circuit shown in FIG. 22.

FIG. 23 is a circuit diagram showing a specific example of the matching circuit in the high-frequency circuit shown in FIG. 22. In FIG. 23, the matching circuit 30 comprises a line 31 and a capacitor 32. The line 31 is connected between the drain of a FET 20 and a node NB, and the capacitor 32 is connected between the node NB and a ground potential.

The frequency dependence of a reflection coefficient in each of the high-frequency circuits shown in FIGS. 21 and 23 has been calculated. In the calculation, a microstrip line has been used as the lines 1, 3, and 31. The thickness of a substrate in the microstrip line is 635 nm, and the dielectric constant thereof is 9.7.

An impedance $Z_{frt}$ in a case where an input side is viewed from the drain of the FET 20 is 10Ω. The characteristic impedance $Z_a$ of the line 1 is 50Ω, and the length $L_a$ thereof is 4160 μm, while the characteristic impedance $Z_b$ of the line 3 is 50Ω, and the length $L_b$ thereof is 1200 μm. The capacitance value C of the capacitor 5 is 5 pF, and the capacitance value $C_g$ of the capacitor 11 is 1000 pF. The characteristic impedance $Z_m$ of the line 31 is 50Ω, the length $L_m$ thereof is 5455 μm, and the capacitance value $C_m$ of the capacitor 32 is 3.9 pF.

Figure 24:
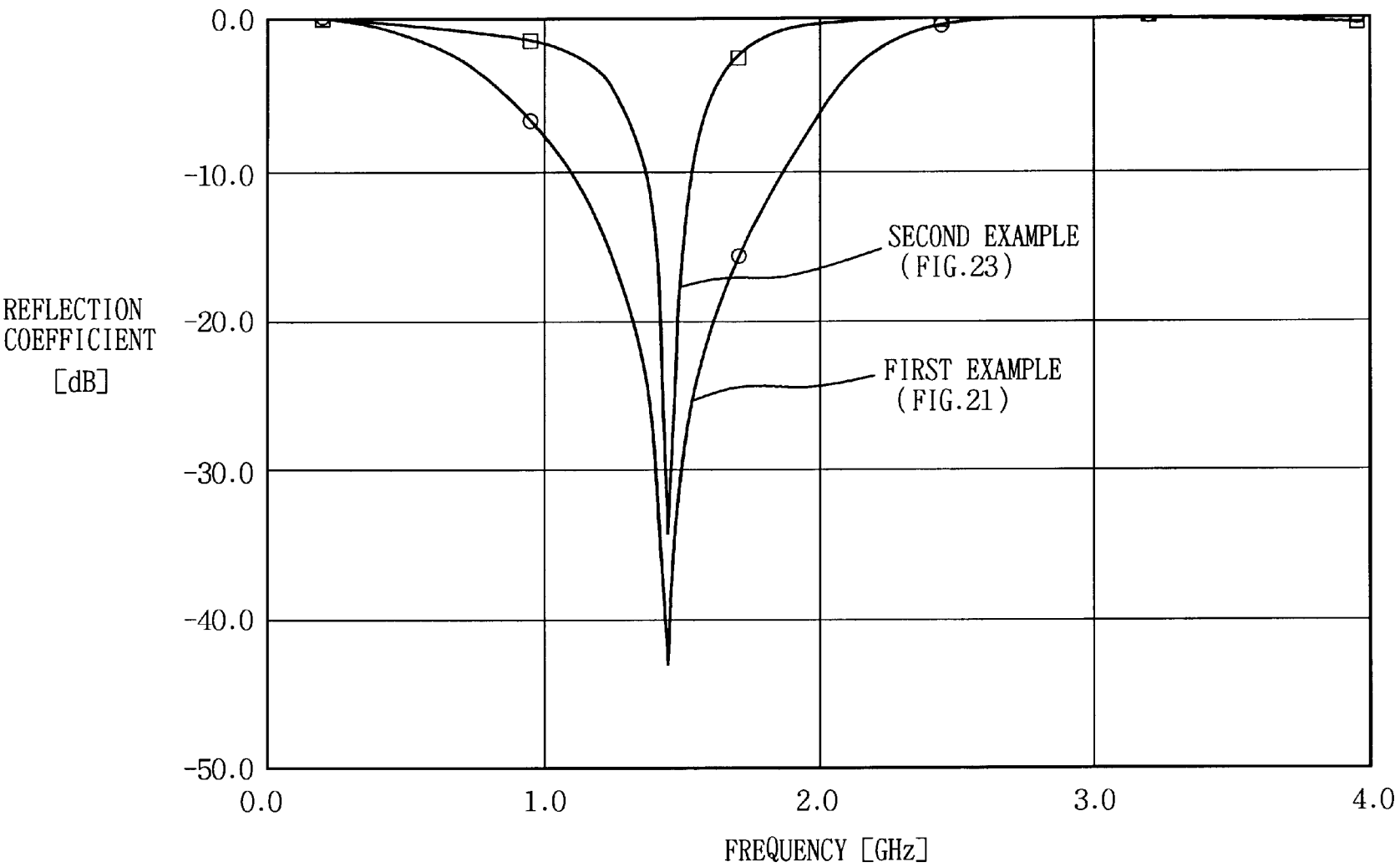
FIG. 24 is a diagram showing the results of calculation of the frequency dependence of a reflection coefficient in each of the high-frequency circuits shown in FIGS. 21 and 23.

The results of the calculation are shown in FIG. 24. As shown in FIG. 24, in the high-frequency circuit in the first example shown in FIG. 21, a reflection coefficient at the port P1 has a wide peak directed downward centered around a frequency of 1.5 GHz. On the other hand, in the high-frequency circuit in the second example shown in FIG. 23, a reflection coefficient at the port P1 has a narrow peak directed downward centered around a frequency of 1.5 GHz. The results indicate that wide band characteristics are obtained in the high-frequency circuit shown in FIG. 21, while narrow band characteristics are obtained in the high-frequency circuit shown in FIG. 23.

Figure 25:
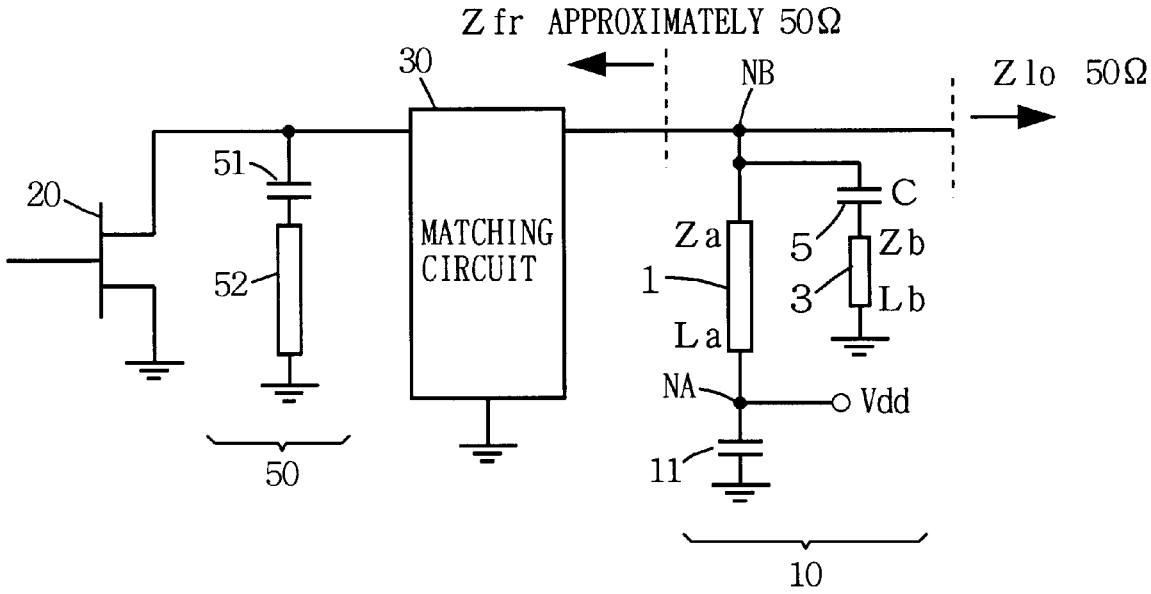
FIG. 25 is a circuit diagram showing still another example of a high-frequency circuit including the bias applying circuit shown in FIG. 5.

FIG. 25 is a circuit diagram showing a third example of a high-frequency circuit including a bias applying circuit using the distributed constant circuit shown in FIG. 5. In the high-frequency circuit shown in FIG. 25, a matching circuit 30 is connected between the drain of a FET 20 and a node NB, a bias applying circuit 10 is connected to the node NB, and a second harmonic processing circuit 50 comprising a capacitor 51 and a line 52 are connected to the drain of the FET 20.

In the high-frequency circuit shown in FIG. 25, a fundamental wave outputted from the drain of the FET 20 is transmitted to the other circuit while suppressing an arbitrary frequency, thereby making it possible to reliably remove the second harmonic relative to a fundamental wave.

Figure 26:
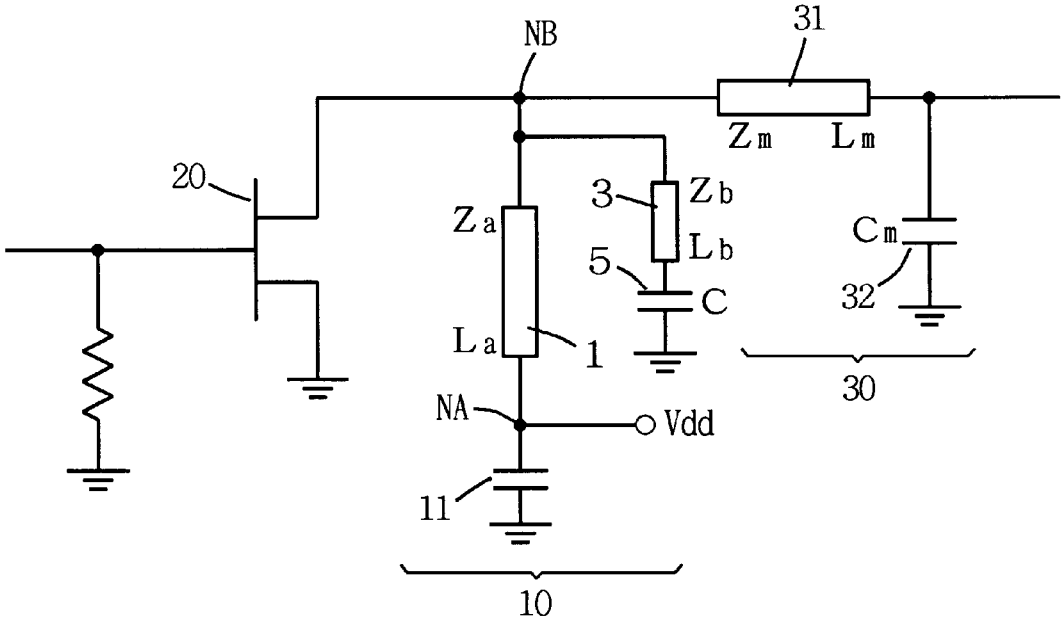
FIG. 26 is a circuit diagram of a high-frequency circuit for explaining the increase in efficiency of a FET.

Description is now made of the conditions of high efficiency using a high-frequency circuit shown in FIG. 26. The high-frequency circuit shown in FIG. 26 has the same arrangement as that of the high-frequency circuit shown in FIGS. 20 and 21. That is, a bias applying circuit 10 is connected to the drain of a FET 20 (a node NB). In the bias applying circuit 10, a line 3 and a capacitor 5 constitute a resonance circuit.

Figure 27:
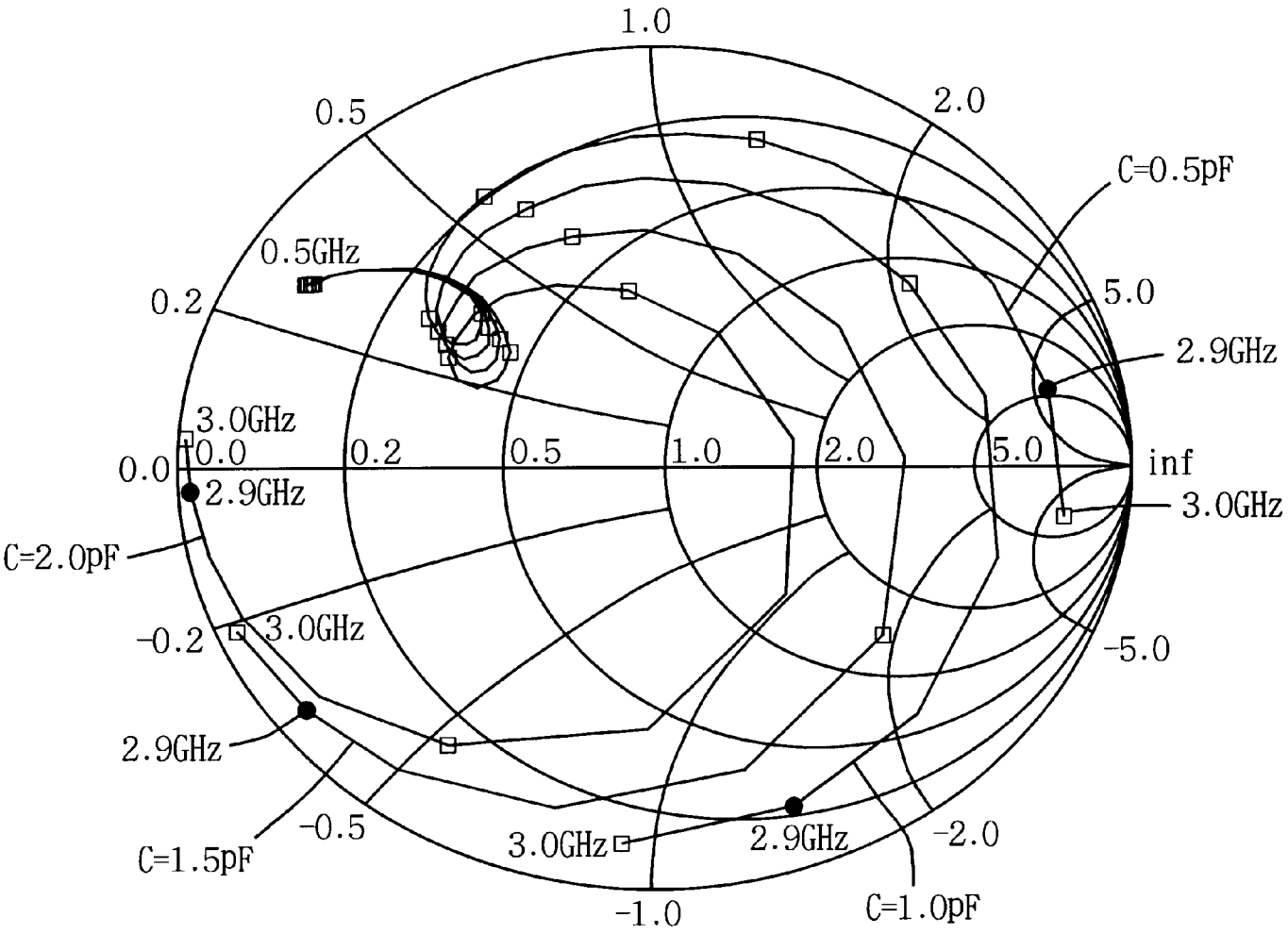
FIG. 27 is a Smith chart showing the results of simulation of the change in a load impedance at the drain terminal of the FET in a case where the capacitance value of a capacitor in a bias applying circuit shown in FIG. 26 is changed.

The change in a load impedance at the drain terminal of the FET 20 in a case where the capacitance value C of the capacitor 5 in the bias applying circuit 10 is changed has been found by simulation. FIG. 27 is a Smith chart showing the results of the simulation of the change in the load impedance at the drain terminal of the FET 20 in a case where the capacitance value C of the capacitor 5 in the bias applying circuit 10 is changed. In the simulation, the capacitance value C of the capacitor 5 in the bias applying circuit 10 has been changed to 2.0 pF, 1.5 pF, 1.0 pF and 0.5 pF. In FIG. 27, load impedances at frequencies of 0.5 to 3.0 GHz are illustrated, and load impedances at a frequency of 2.9 GHz of second harmonics are particularly indicated by black circular marks.

When the capacitance value C of the capacitor 5 and the impedance of the line 3 are changed, to change a resonance frequency, characteristics at frequencies which are not more than the resonance frequency are also changed, so that the load impedances at the frequencies which are not more than the resonance frequency are also changed.

When the capacitance value C of the capacitor 5 is 2.0 pF, the load impedance at the frequency of 2.9 GHz of the second harmonic is approximately zero, that is, the drain terminal of the FET 20 is substantially in a short-circuited state. It is found that the load impedance at the frequency of 2.9 GHz of the second harmonics is changed by changing the capacitance value C of the capacitor 5 to 1.5 pF, 1.0 pF, and 0.5 pF.

Figure 28:
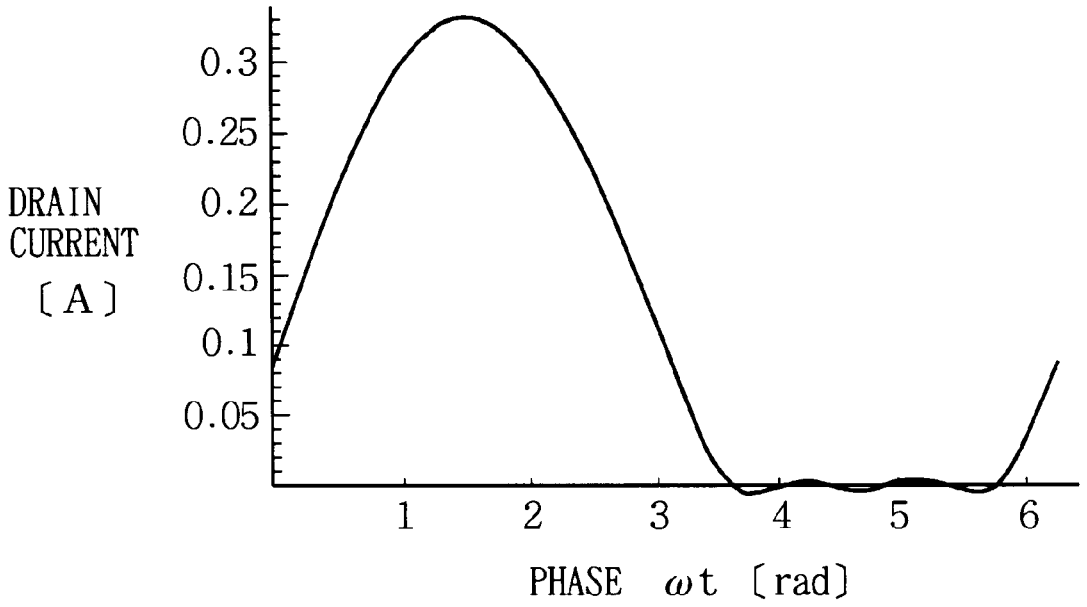
FIG. 28 is a waveform diagram of a drain current in a AB-class operation of the FET.

FIG. 28 is a waveform diagram showing a drain current in an AB-class operation of the FET 20. FIG. 28 illustrates a pseudo waveform obtained by subjecting the waveform of the drain current in the AB-class operation of the FET 20 to Fourier series expansion from the first harmonic to the sixth harmonic.

Figure 29:
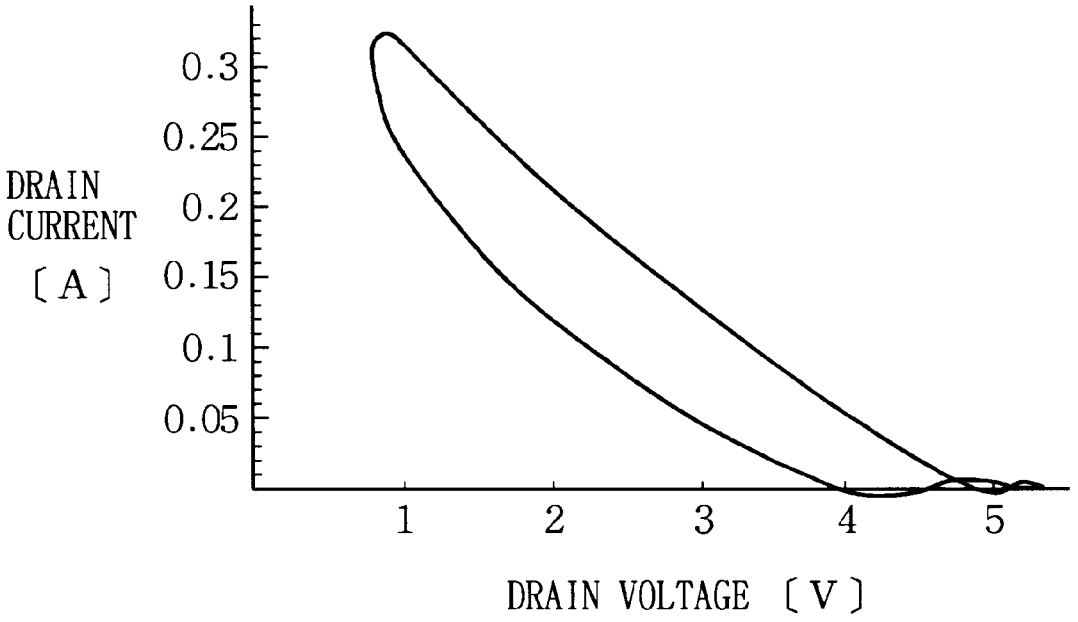
FIG. 29 is a diagram showing a load line in a case where the drain terminal of the FET is brought into a short-circuited state in the bias applying circuit shown in FIG. 26.
Figure 30:
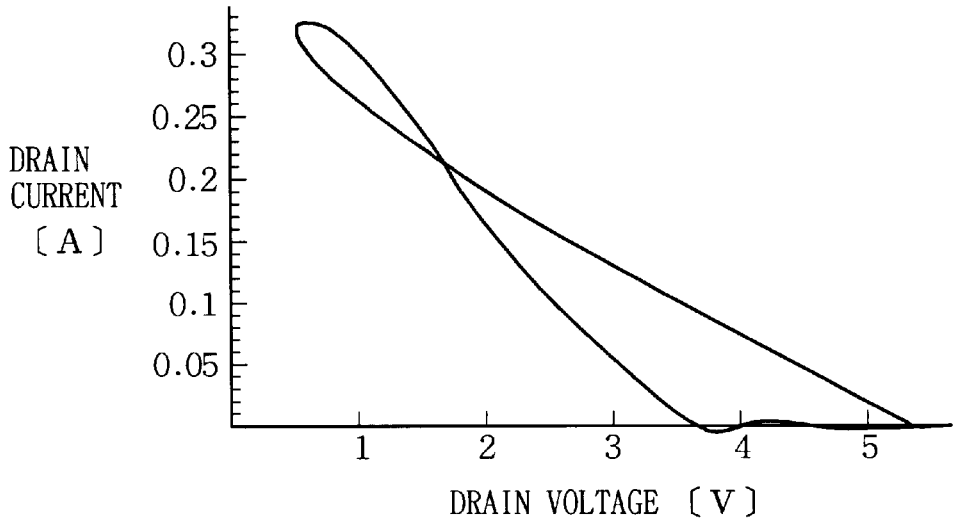
FIG. 30 is a diagram showing a load line in a case where the drain terminal of the FET is not brought into a short-circuited state in the bias applying circuit shown in FIG. 26.

FIG. 29 is a diagram showing a load line in a case where a load impedance in the FET 20 at the second harmonics is zero (that is, in a short-circuited state), and FIG. 30 is a diagram showing a load line in a case where a load impedance in the FET 20 at the second harmonics is not zero. In FIGS. 29 and 30, the horizontal axes indicates a drain voltage, and the vertical axes indicate a drain current.

FIG. 29 illustrates a case where the magnitude of a load impedance at a frequency other than the second harmonics is 0.415 and the angle thereof is 153 degrees, and the magnitude of a load impedance at the second harmonics is zero (a state A). FIG. 30 illustrates a case where the magnitude of a load impedance at a frequency other than the second harmonics is 0.415 and the angle thereof is 153 degrees, and the magnitude of a load impedance at the second harmonics is 0.96 and the angle thereof is −143 degrees (a state B).

The integrated values over one period of the drain current and the drain voltage in FIGS. 29 and 30 are respectively 1.12 J and 1.08 J. The integrated value represents energy to be a loss. The results indicate that a loss in the state B where no short-circuited state occurs with respect to the second harmonics is smaller than a loss in the state A where a short-circuited state occurs with respect to the second harmonics. Consequently, it is possible to achieve high efficiency.

The input/output characteristics of the FET 20 in the high-frequency circuit shown in FIG. 26 have been then measured. In the measurement, third harmonics are not in a short-circuited state. A source and a load impedance have been changed such that adjacent channel leakage power characteristics(ACP characteristics) detuned by 50 kHz is −50 dBc and power-added efficiency is the maximum, to measure the input/output characteristics. The gate width of the FET 20 is 1.6 mm, and an idle current (a current in the no signal state) is 92 mA. The frequency of a fundamental wave is 1.45 GHz. As bias conditions, a drain bias is 3.5 V, and a gate bias is 0 V. The length $L_a$ of the line 1 is 8.9 mm, which is not more than one-fourth the length of the λ/4 line. The results of the measurement are shown in Table 1.

TABLE 1

| state | Impedance of fundamental wave (magnitude, angle[deg.]) | Impedance of second harmonics (magnitude, angle[deg.]) | Pout/Pin [dBm/dBm] | Power-added efficiency [%] |
|---|---|---|---|---|
| a | 0.38,173 | 0.98,−177 | 23.6/6.5 | 42 |
| b | 0.42,153 | 0.96,−143 | 23.7/4.8 | 50 |
| c | 0.44,148 | 0.90,−71 | 23.4/5.0 | 46 |
| d | 0.47,145 | 0.91,13.5 | 23.0/4.8 | 42 |

In Table 1, a state a shows a case where the magnitude of the impedance at second harmonics is approximately 1.0, and the angle thereof is −180 degrees. That is, in the state a, the drain terminal of the FET 20 is in an almost short-circuited state. On the other hand, in a state b, a state c, and a state d, the drain terminal of the FET 20 is not in a short-circuited state with respect to the second harmonics.

From the results shown in Table 1, in the state b where the magnitude of the impedance of the second harmonics is 0.957 (≈0.96) and the angle thereof is −143 degrees, power-added efficiency is 50%, which is higher by 8% than that in the state a where a short-circuited state occurs with respect to the second harmonics.

It is possible to achieve high efficiency by thus setting the resonance frequencies of the line 3 and the capacitor 5 to frequencies higher than the frequency of the second harmonics. Further, the length of the line 1 is smaller than the length of the λ/4 line, so that it is possible to achieve miniaturization.

Figure 31:
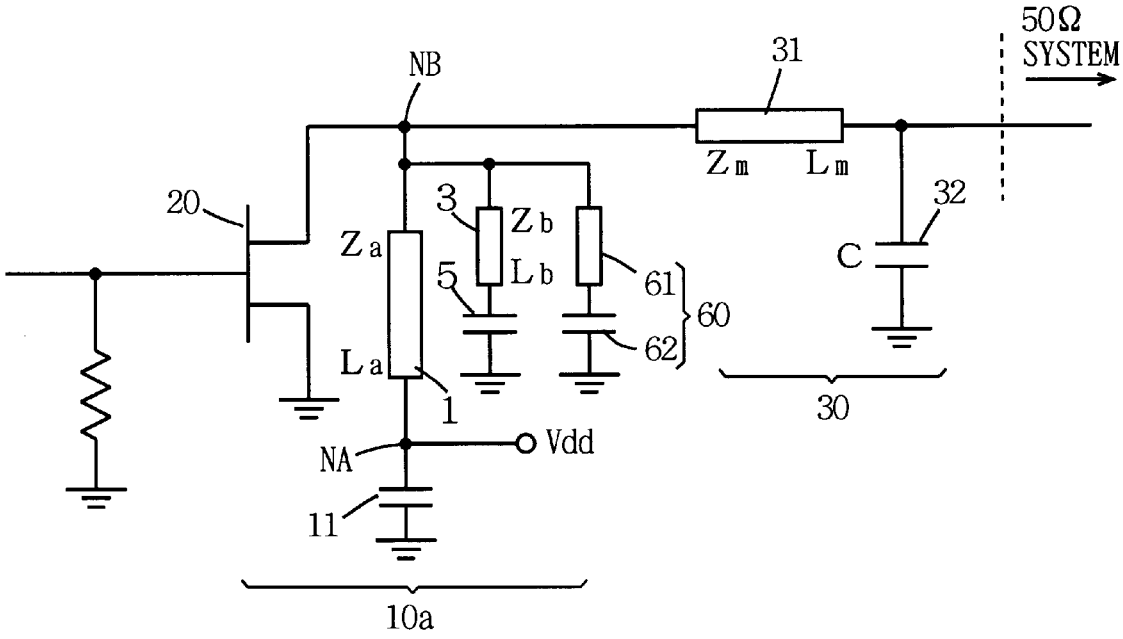
FIG. 31 is a circuit diagram mainly showing a bias applying circuit including a third harmonic processing circuit.

FIG. 31 is a circuit diagram showing still another example of a bias applying circuit. A bias applying circuit 10*a* shown in FIG. 31 comprises a third harmonic processing circuit 60 in addition to the bias applying circuit 10 shown in FIG. 26. The third harmonic processing circuit 60 comprises a series connection between a line 61 and a capacitor 62, and is connected between a node NB and a ground potential.

Also in the bias applying circuit 10*a* shown in FIG. 31, the resonance frequencies of the line 3 and the capacitor 5 are set to frequencies higher than the frequency of the second harmonic, thereby making it possible to achieve high efficiency as well as to suppress third harmonics by the third harmonic processing circuit 60.

Figure 32:
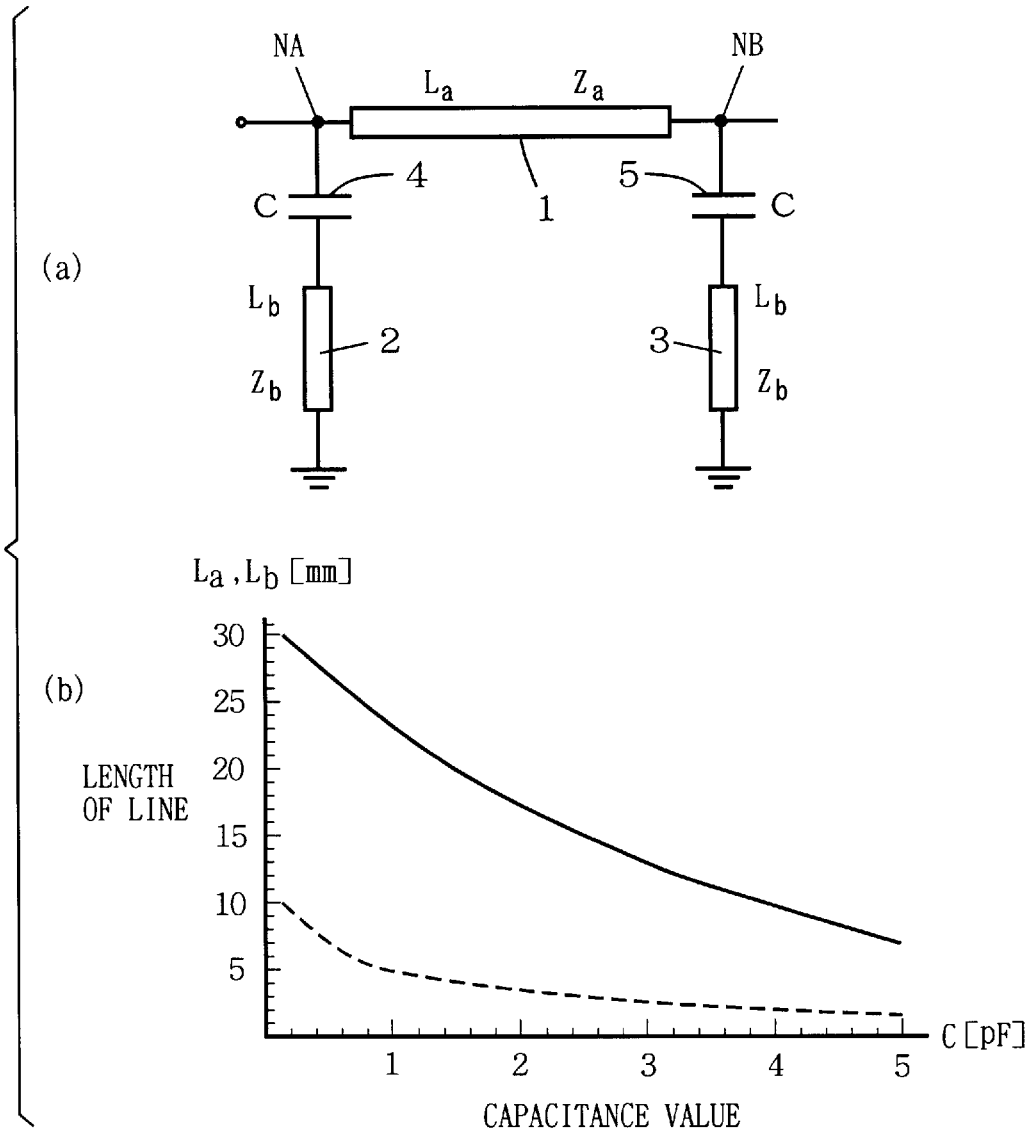
FIG. 32 is a diagram showing the relation between the capacitance value of a capacitor and the length of a line in the distributed constant circuit according to the embodiment shown in FIG. 1.

FIG. 32 is a diagram showing the relation between the capacitance values of the capacitors 4 and 5 and the lengths of the lines 1, 2 and 3 in the distributed constant circuit in the embodiment shown in FIG. 1. FIG. 32 (*a*) illustrates the distributed constant circuit in the embodiment shown in FIG. 1, and FIG. 32 (*b*) illustrates the results of calculation of the relation between the capacitance values of the capacitors 4 and 5 and the lengths of the lines 1, 2, and 3.

In FIG. 32 (*b*), the horizontal axis indicates the capacitance value C of the capacitors 4 and 5, the vertical axis indicates the length La of the line 1 and the length Lb of the lines 2 and 3, a solid line indicates the relation between the capacitance value C of the capacitors 4 and 5 and the length $L_a$ of the line 1, and a dotted line indicates the relation between the capacitance value C of the capacitors 4 and 5 and the length $L_b$ of the lines 2 and 3.

Figure 33:
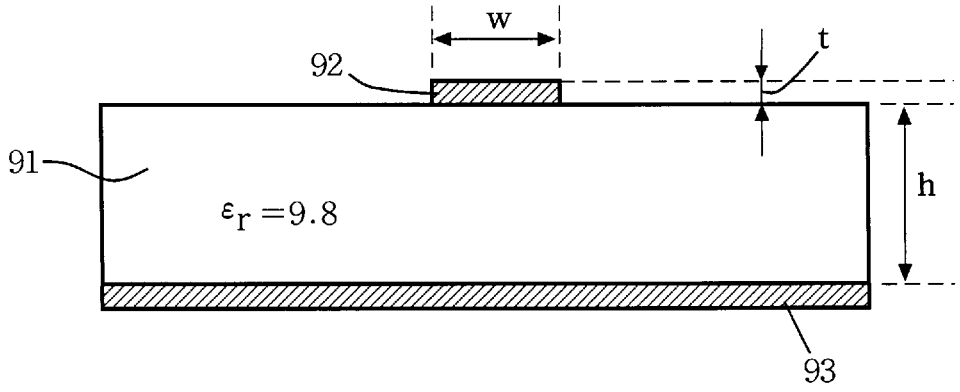
FIG. 33 is a cross-sectional view showing a microstrip line.

As the lines 1, 2, and 3, a microstrip line shown in FIG. 33 is used. The microstrip line shown in FIG. 33 comprises a ceramic substrate 91, a microstrip conductor 92, and a ground conductor 93. The dielectric constant $\epsilon_r$ of the ceramic substrate 91 is 9.8, and the thickness h thereof is 635 μm. The width w of the microstrip conductor 92 is 300 μm, and the thickness t thereof is 10 μm. The frequency $f_1$ of a fundamental wave is 950 MHz.

FIG. 32 (*b*) shows that as the capacitance value C of the capacitors 4 and 5 increases, the length $L_a$ of the line 1 and the length $L_b$ of the lines 2 and 3 decrease.

Figure 34:
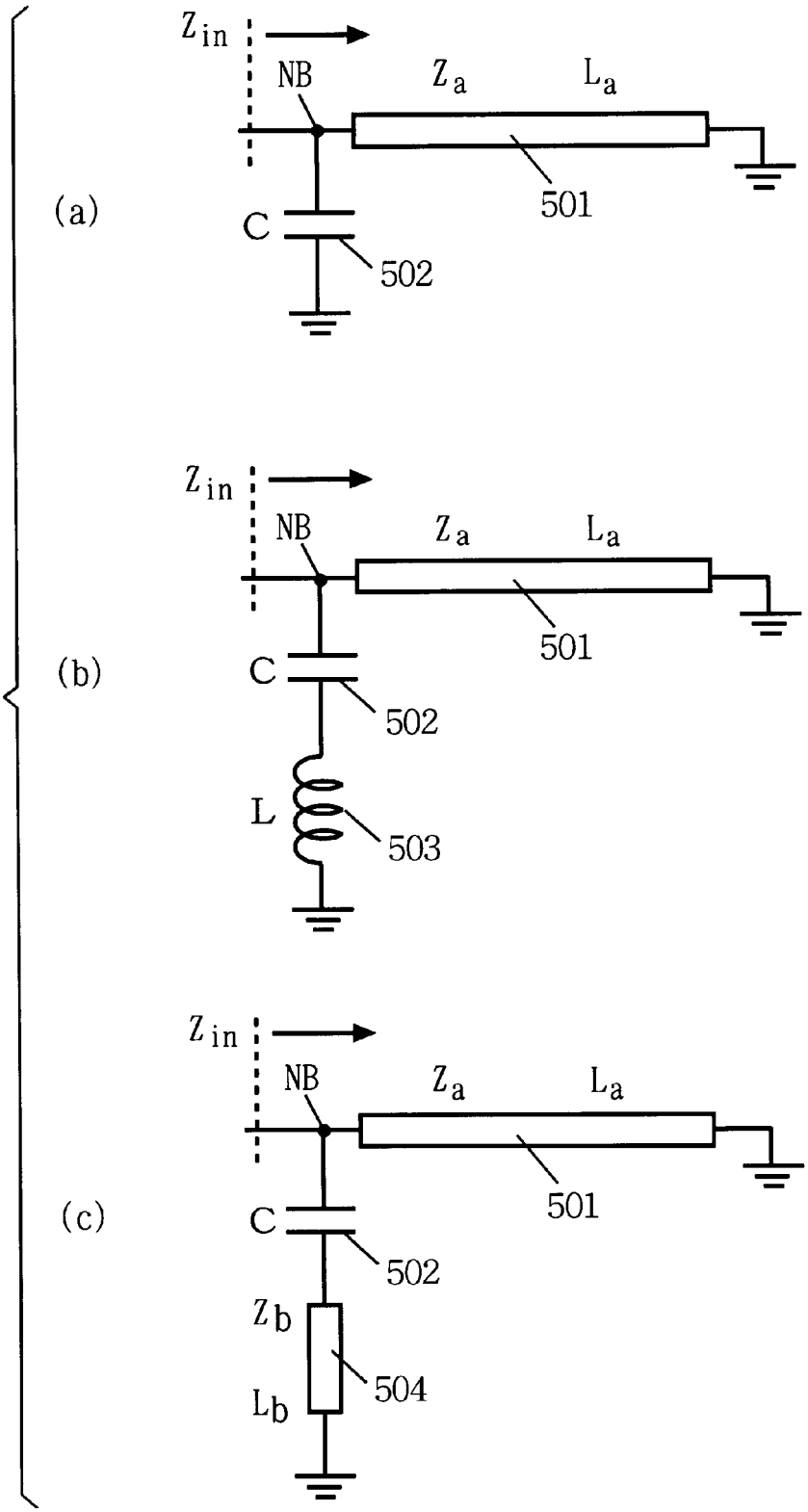
FIG. 34 is a circuit diagram of a distributed constant circuit according to another embodiment of the present invention.

FIG. 34 is a circuit diagram of a distributed constant circuit in another embodiment of the present invention. The distributed constant circuit shown in FIG. 34 functions as an inductor when particular conditions are satisfied.

In an example shown in FIG. 34 (*a*), a node NB is grounded through a line 501, and is grounded through a capacitor 502. Let λ be a wavelength, ω be an angular frequency, $Z_a$ be the characteristic impedance of a line 501, $L_a$ be the length of the line 501, and C be the capacitance value of the capacitor 502, where $L_a < \lambda/4$. An input impedance $Z_{in}$ is expressed by the following equation:

$$Z_{in} = \frac{jZ_a \tan\left(\frac{2\pi}{\lambda} L_a\right)}{1 - \omega C Z_a \tan\left(\frac{2\pi}{\lambda} L_a\right)}$$

If $1-\omega C Z_a \tan[(2\pi/\lambda)L_a]=0$, the input impedance $Z_{in}$ increases to infinity, and the node NB enters an open state. Further, if $1>\omega C Z_a \tan[(2\pi/\lambda)L_a]$, $Z_{in}=jX$. X is a reactance, and X>0. Consequently, the distributed constant circuit shown in FIG. 34 (*a*) functions as an inductor.

In an example shown in FIG. 34 (*b*), a node NB is grounded through a line 501, and is grounded through a capacitor 502 and an inductor component 503. Let L be the inductance of the inductor component 503, where $L_a<\lambda/4$. In this case, an input impedance $Z_{in}$ is expressed by the following equation:

$$Z_{in} = j\frac{\left(\omega L - \frac{1}{\omega C}\right)Z_a \tan\left(\frac{2\pi}{\lambda}L_a\right)}{\left(\omega L - \frac{1}{\omega C}\right) + Z_a \tan\left(\frac{2\pi}{\lambda}L_a\right)}$$

If $1/\omega C=\omega L+Z_a\tan[(2\pi/\lambda)L_a]$, the input impedance $Z_{in}$ increases to infinity, and the node NB enters an open state. Further, if $1/\omega C>\omega L+Z_a\tan[(2\pi/\lambda)L_a]$, $Z_{in}=jX$ $(X>0)$. Consequently, the distributed constant circuit shown in FIG. 34 (*a*) functions as an inductor. The inductor component 503 shown in FIG. 34 (*b*) may be an inductor component appended to a chip capacitor.

With respect to a particular frequency satisfying $\omega L=1/\omega C$, the input impedance $Z_{in}$ becomes zero, and the node NB enters a short-circuited state to a ground potential.

Consequently, the distributed constant circuit shown in FIG. 34 (*b*) can enter an open state with respect to a fundamental wave or operate as an inductor, and can enter a short-circuited state with respect to a particular frequency. Utilization of this makes it possible to perform harmonic processing in a load.

In an example shown in FIG. 34 (*c*), a node NB is grounded through a line 501, and is grounded through a capacitor 502 and a line 504. Let $Z_b$ be the characteristic impedance of the line 504, and $L_b$ be the length thereof, where $L_a<\lambda/4$ and $L_b<\lambda/4$. In this case, an input impedance $Z_{in}$ is expressed by the following equation:

$$Z_{in} = j\frac{\left(Z_b \tan\left(\frac{2\pi}{\lambda}L_b\right) - \frac{1}{\omega C}\right)Z_a \tan\left(\frac{2\pi}{\lambda}L_a\right)}{Z_b \tan\left(\frac{2\pi}{\lambda}L_b\right) - \frac{1}{\omega C} + Z_a \tan\left(\frac{2\pi}{\lambda}L_a\right)}$$

If $1\omega C=Z_b\tan[(2\pi/\lambda)L_b)]+Z_a\tan[(2\pi/\lambda)L_a]$, the input impedance $Z_{in}$ increases to infinity, and the node NB enters an open state. Further, if $1/\omega C>Z_b\tan[(2\pi/\lambda)L_b]+Z_a\tan[(2\pi/\lambda)L_a,]Z_{in}=jX$ $(X>0)$. Consequently, the distributed constant circuit shown in FIG. 34 (*c*) functions as an inductor.

With respect to a particular frequency satisfying $1/\omega C=Z_b\tan[(2\pi/\lambda)L_b]$the input impedance $Z_{in}$ becomes zero, and the node NB enters a short-circuited state to a ground potential.

Consequently, the distributed constant circuit shown in FIG. 34 (*c*) can enter an open state with respect to a fundamental wave or operate as an inductor, and can enter a short-circuited state with respect to a particular frequency. Utilization of this makes it possible to perform harmonic processing in a load.

Consider a case where the same input impedance is obtained. In any of the examples shown in FIGS. 34 (*a*), 34 (*b*) and 34 (*c*), if the capacitance value C of the capacitor 502 is increased, the length $L_a$ of the line 501 is decreased.

Figure 35:
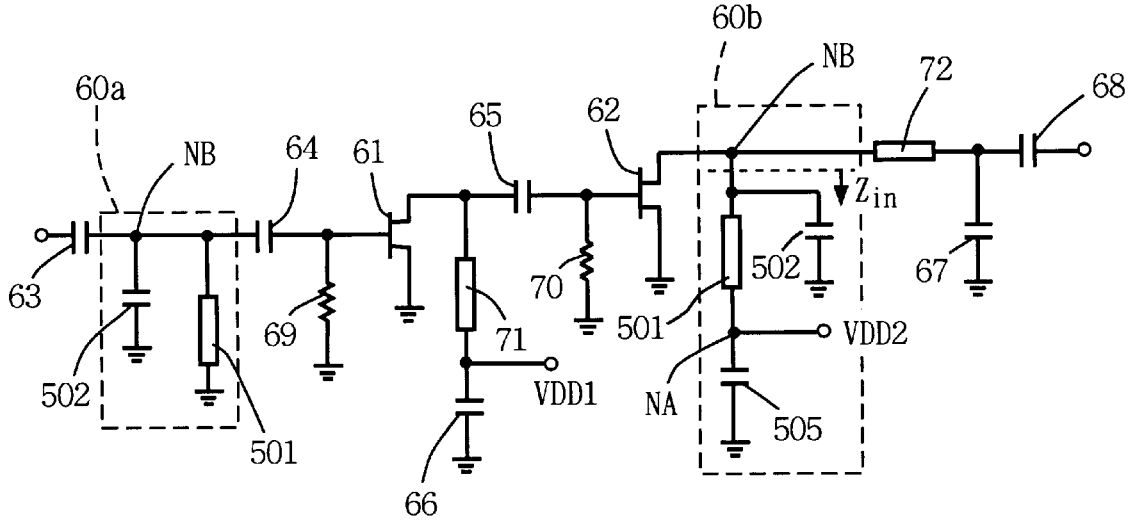
FIG. 35 is a circuit diagram showing one example of an amplifier using the distributed constant circuit shown in FIG. 34.

FIG. 35 is a circuit diagram showing one example of an amplifier using the distributed constant circuit shown in FIG. 34. The amplifier shown in FIG. 35 comprises two FETs 61 and 62, distributed constant circuits 60*a* and 60*b*, capacitors 63, 64, 65, 66, 67, and 68, resistors 69 and 70, and lines 71 and 72. A capacitor 502 in each of the distributed constant circuits 60*a* and 60*b* is a chip capacitor, and includes an inductor component of 0.9 nH. Consequently, the distributed constant circuits 60*a* and 60*b* actually have the arrangement shown in FIG. 34 (*b*).

The distributed constant circuit 60*a* functions as a parallel inductor, and constitutes a part of a matching circuit. A drain bias VDD1 is applied to the drain of the FET 61 through the line 71.

In the distributed constant circuit 60*b*, a line 501 is connected between a node NA and a node NB, the node NA is grounded through a capacitor 505, and the node NB is connected to the drain of the FET 62. Further, the node NB is grounded through the capacitor 502. A drain bias VDD2 is applied to the node NA.

The distributed constant circuit 60*b* functions as a parallel inductor and functions as a high-frequency processing circuit, and constitutes a drain bias circuit and constitutes a part of a matching circuit. The input impedance $Z_{in}$ of the distributed constant circuit 60*b* is approximately 40Ω. Since a load impedance on the side of the FET 62 is as low as several ohms, an output signal of the FET 62 does not leak toward a power supply for supplying the drain bias VDD2.

In the amplifier shown in FIG. 35, the short line 501 can constitute an inductor by using the distributed constant circuits 60*a* and 60*b*. Consequently, the amplifier can be miniaturized.

Consider a case where an inductor of approximately 12 nH (11.8 nH) having its one end grounded at a frequency of 950 MHz is formed using the microstrip line shown in FIG. 33.

When only the microstrip line is used, the length of the line is 16.3 mm. Conversely, when the distributed constant circuit shown in FIG. 34 (*b*) is used, the length $L_a$ of the line 501 is 8.36 mm. The capacitance value C of the capacitor 502 is 3 pF, and the inductance L of the inductor component 503 is 0.9 nH.

At this time, the input impedance $Z_{in}$ becomes zero by resonance between the capacitor 502 and the inductor component 503 at a frequency of 3.06 GHz, so that the node NB enters a short-circuited state to a ground potential.

The distributed constant circuit shown in FIG. 34 is utilized as an inductor, thereby making it possible to miniaturize the circuit.

Figure 36:
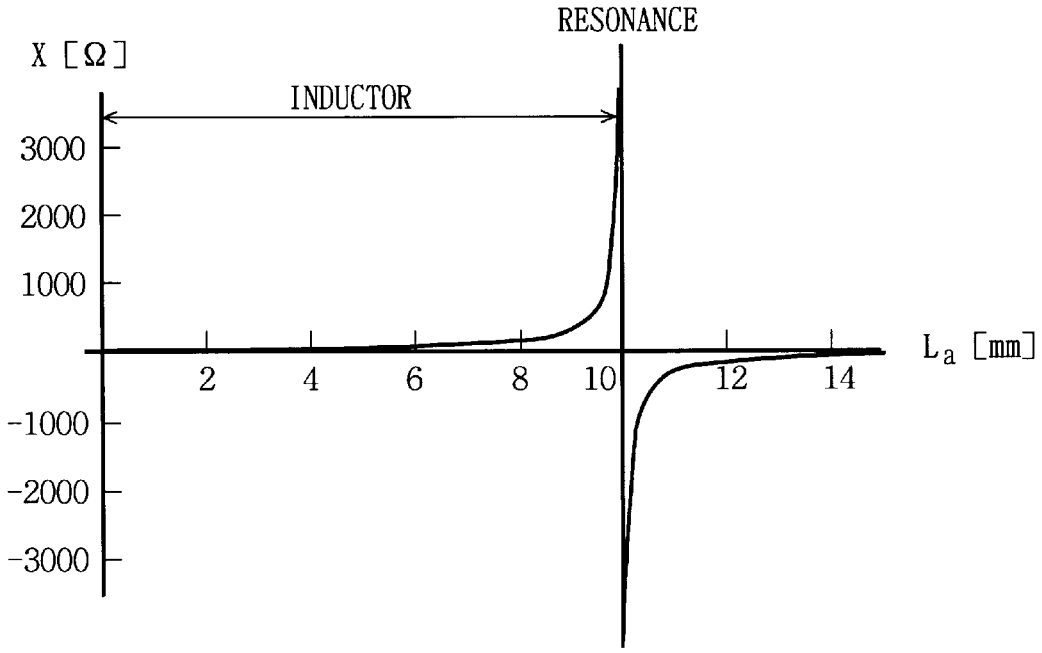
FIG. 36 is a diagram showing the results of calculation of the relation between the length of a line and an input impedance in the distributed constant circuit shown in FIG. 34(*b*)
Figure 37:
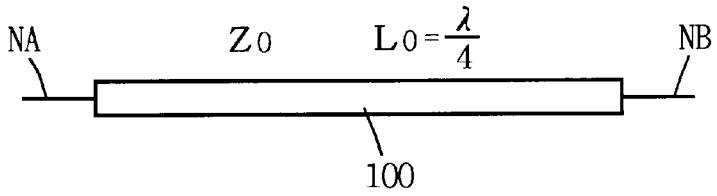
FIG. 37 PRIOR ART
FIG. 37 is a diagram showing a conventional λ/4 line.

FIG. 36 is a diagram showing the results of calculation of the relation between the length $L_a$ of the line 501 and the input impedance $Z_{in}$ in the distributed constant circuit shown in FIG. 34 (*b*). In FIG. 36, the horizontal axis indicates the length $L_a$ the line 501, and the vertical axis indicates the reactance X of the input impedance $Z_{in}$.

The dielectric constant $\epsilon_r$ of the ceramic substrate 91 is 9.8, and the thickness h thereof is 635 μm. The width w of the microstrip conductor 92 is 300 μm, and the thickness t thereof is 10 μm. The frequency is 950 MHz. The characteristic impedance $Z_a$ of the line 501 is 66.0Ω. The capacitance value C of the capacitor 502 is 4 pF, and the inductance L of the inductor component 503 is 0.9 nH.

As shown in FIG. 36, in a range in which the length $L_a$ of the line 501 is more than zero and less than 10 mm, the distributed constant circuit functions as an inductor. When the length $L_a$ of the line 501 is 10 mm, resonance occurs, so that the input impedance $Z_{in}$ of the distributed constant circuit increases to infinity, and the node NB enters an open state.

When the circuit is constructed using a chip part, a chip inductor is higher in cost than a chip capacitor. In an MMIC (Monolithic Microwave Integrated Circuit), a spiral inductor has a large area on a chip. When a parallel inductor is constituted by a chip inductor or a spiral inductor, therefore, the cost thereof is increased and the area thereof is increased.

On the other hand, when the distributed constant circuit shown in FIG. 34 is used as an inductor, the length $L_a$ of the line 501 can be decreased by increasing the capacitance value C of the capacitor 502. Consequently, it is possible to lower the cost of the circuit and miniaturize the circuit.

The distributed constant circuit shown in FIG. 34 can be used for a bias circuit, a matching circuit, a filter, and so forth.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A distributed constant circuit comprising:

a first distributed constant transmission line;

a first capacitor;

a second distributed constant transmission line connected in series with said first capacitor;

a second capacitor; and a third distributed constant transmission line connected in series with said second capacitor, said distributed constant circuit having a structure in which one end of said first distributed constant transmission line is connected to a predetermined reference potential through a series connection between said first capacitor and said second distributed constant transmission line, and the other end of said first distributed constant transmission line is connected to said reference potential through a series connection between said second capacitor and said third distributed constant transmission line, the other end of said first distributed constant transmission line being in a substantially open state with respect to a first frequency and being in a substantially short-circuited state with respect to a second frequency different from said first frequency when the one end of said first distributed constant transmission line is brought into a grounded state in an alternating current manner, the characteristic impedance $Z_a$ of said first distributed constant transmission line, the length $L_a$ of said first distributed constant transmission line, the characteristic impedance $Z_b$ of said second and third distributed constant transmission lines, the length $L_b$ of said second and third distributed constant transmission lines, the capacitance value C of said first and second capacitors, a first frequency $f_1$, a wavelength $\lambda_1$ corresponding to said first frequency, a second frequency $f_2$, and a wavelength $\lambda_2$ corresponding to said second frequency satisfy relations expressed by equations (1), (2) and (3):

$$L_a = \frac{\lambda_1}{2\pi}\arctan\left\{\frac{1}{Z_a}\left(\frac{1}{2\pi f_1 C} - Z_b \tan\frac{2\pi}{\lambda_1}L_b\right)\right\} \quad (1)$$

$$L_b = \frac{\lambda_2}{2\pi}\arctan\frac{1}{C\cdot 2\pi f_2 Z_b} \quad (2)$$

$$Z_a = \frac{Z_0}{\sin\frac{2\pi}{\lambda_1}L_a}. \quad (3)$$

2. A distributed constant circuit comprising:

a first distributed constant transmission line;

a capacitor; and a second distributed constant transmission line connected in series with said capacitor, said distributed constant circuit having a structure in which one end of said first distributed constant transmission line is connected to a predetermined reference potential in an AC manner, and the other end of said first distributed constant transmission line is connected to said reference potential through a series connection between said capacitor and said second distributed constant transmission line, the other end of said first distributed constant transmission line being in a substantially open state with respect to a first frequency and being in a substantially short-circuited state with respect to a second frequency different from said first frequency when the one end of said first distributed constant transmission line is brought into a grounded state in an alternating current manner, the characteristic impedance $Z_a$ of said first distributed constant transmission line, the length $L_a$ of said first distributed constant transmission line, the characteristic impedance $Z_b$ of said second distributed constant transmission line, the length $L_b$ of said second distributed constant transmission line, the capacitance value C of said capacitor, a first frequency $f_1$, a wavelength $\lambda_1$ corresponding to the first frequency, a second frequency $f_2$, and a wavelength $\lambda_2$ corresponding to said second frequency satisfy relations expressed by equations (1), (2) and (3):

$$L_a = \frac{\lambda_1}{2\pi}\arctan\left\{\frac{1}{Z_a}\left(\frac{1}{2\pi f_1 C} - Z_b \tan\frac{2\pi}{\lambda_1}L_b\right)\right\} \quad (1)$$

$$L_b = \frac{\lambda_2}{2\pi}\arctan\frac{1}{C\cdot 2\pi f_2 Z_b} \quad (2)$$

$$Z_a = \frac{Z_0}{\sin\frac{2\pi}{\lambda_1}L_a}. \quad (3)$$

3. A distributed constant circuit comprising:

a first distributed constant transmission line;

a capacitor; and a second distributed constant transmission line connected in series with said capacitor, said distributed constant circuit having a structure in which one end of said first distributed constant transmission line is connected to a predetermined reference potential in an AC manner, and the other end of said first distributed constant transmission line is connected to said reference potential through a series connection between said capacitor and said second distributed constant transmission line, the other end of said first distributed constant transmission line being in a substantially open state with respect to a first frequency and being in a substantially short-circuited state with respect to a second frequency different from said first frequency when the one end of said first distributed constant transmission line is brought into a grounded state in an alternating current manner, said one end of said first distributed constant transmission line is connected to a bias voltage, and said other end of said first line is connected to an electrode of a transistor.

4. The distributed constant circuit according to claim 3, wherein said first frequency is the frequency of a fundamental wave, and said second frequency is higher than the frequency of a second harmonic of said fundamental wave.

5. A distributed constant circuit comprising:

a first distributed constant transmission line;

a first capacitor;

a second distributed constant transmission line connected in series with said first capacitor;

a first impedance element;

a second capacitor;

a third distributed constant transmission line connected in series with said second capacitor; and a second impedance element, said distributed constant circuit having a structure in which one end of said first distributed constant transmission line is connected to a predetermined reference potential through a series connection between said first capacitor and said second distributed constant transmission line and connected to said reference potential through the first impedance element, and the other end of said first distributed constant transmission line is connected to said reference potential through a series connection between said second capacitor and said third distributed constant transmission line and connected to said reference potential through said second impedance element, the other end of said first distributed constant transmission line being in a substantially open state with respect to a first frequency and being in a substantially short-circuited state with respect to a second frequency different from said first frequency when the one end of said first line is brought into a grounded state in an alternating current manner.

6. The distributed constant circuit according to claim 5, wherein the characteristic impedance $Z_a$ of said first distributed constant transmission line, the length $L_a$ of said first distributed constant transmission line, the characteristic impedances $Z_b$ of said second and third distributed constant transmission lines, the length $L_b$ of said second and third distributed constant transmission lines, the capacitance value C of said first and second capacitors, the impedance $Z_c$ of said first and second impedance elements, a first frequency $f_1$, a wavelength $\lambda_1$, corresponding to said first frequency, a second frequency $f_2$, and a wavelength $\lambda_2$ corresponding to said second frequency satisfy relations expressed by equations (4), (5) and (6):

$$L_a = \frac{\lambda_1}{2\pi}\arctan\left\{\frac{\frac{jZ_c}{Z_a}\left(\frac{1}{j2\pi f_1 C} + jZ_b\tan\frac{2\pi}{\lambda_1}L_b\right)}{Z_c + \frac{1}{j2\pi f_1 C} + jZ_b\tan\frac{2\pi}{\lambda_1}L_b}\right\} \tag{4}$$

$$L_b = \frac{\lambda_2}{2\pi}\arctan\frac{1}{C\cdot 2\pi f_2 Z_b} \tag{5}$$

$$Z_a = \frac{Z_0}{\sin\frac{2\pi}{\lambda_1}L_a}. \tag{6}$$

7. The distributed constant circuit according to claim 5, wherein each of said first and second impedance elements comprises an impedance device.

8. The distributed constant circuit according to claim 5, wherein said first and second impedance elements are adjusted in impedance value when circuits connected to one end and the other end of said first distributed constant transmission line are respectively viewed from the one end and the other end.

9. A distributed constant circuit comprising:

a first distributed constant transmission line;

a capacitor;

a second distributed constant transmission line connected in series with said capacitor; and an impedance element, said distributed constant circuit having a structure in which one end of said first distributed constant transmission line is connected to a predetermined reference potential in an AC manner, and the other end of said first distributed constant transmission line is connected to said reference potential through a series connection between said capacitor and said second distributed constant transmission line and connected to said reference potential through said impedance element, the other end of said first distributed constant transmission line being in a substantially open state with respect to a first frequency and being in a substantially short-circuited state with respect to a second frequency different from said first frequency when the one end of said first distributed constant transmission line is brought into a grounded state in an alternating current manner.

10. The distributed constant circuit according to claim 9, wherein the characteristic impedance $Z_a$ of said first distributed constant transmission line, the length $L_a$ of said first distributed constant transmission line, the characteristic impedance $Z_b$ of said second distributed constant transmission line, the length $L_b$ of said second distributed constant transmission line, the capacitance value C of said capacitor, the impedance $Z_c$ of said impedance element, a first frequency $f_1$, a wavelength $\lambda_1$ corresponding to said first frequency, a second frequency $f_2$, and a wavelength $\lambda_1$ corresponding to said second frequency satisfy relations expressed by equations (4), (5) and (6):

$$L_a = \frac{\lambda_1}{2\pi}\arctan\left\{\frac{\frac{jZ_c}{Z_a}\left(\frac{1}{j2\pi f_1 C} + jZ_b\tan\frac{2\pi}{\lambda_1}L_b\right)}{Z_c + \frac{1}{j2\pi f_1 C} + jZ_b\tan\frac{2\pi}{\lambda_1}L_b}\right\} \tag{4}$$

$$L_b = \frac{\lambda_2}{2\pi}\arctan\frac{1}{C\cdot 2\pi f_2 Z_b} \tag{5}$$

$$Z_a = \frac{Z_0}{\sin\frac{2\pi}{\lambda_1}L_a}. \tag{6}$$

11. The distributed constant circuit according to claim 9, wherein said impedance element comprises an impedance device.

12. The distributed constant circuit according to claim 9, wherein said impedance element is adjusted in impedance value when a circuit connected to the other end of said first distributed constant transmission line is viewed from said other end.

13. The distributed constant circuit according to claim 9, wherein said one end of said first distributed constant transmission line is connected to a bias voltage, and said other end of said first distributed constant transmission line is connected to an electrode of a transistor.

14. The distributed constant circuit according to claim 13, wherein said first frequency is the frequency of a fundamental wave, and said second frequency is higher than the frequency of a second harmonic of said fundamental wave.

15. A distributed constant circuit comprising:

a first distributed constant transmission line;

a first capacitor;

a second distributed constant transmission line connected in series with said first capacitor;

a first impedance element;

a second capacitor;

a third distributed constant transmission line connected in series with said second capacitor; and a second impedance element, said distributed constant circuit having a structure in which one end of said first distributed constant transmission line is connected to a predetermined reference potential through a series connection between said first capacitor and said second distributed constant transmission line, and is connected to said reference potential through the first impedance element, and the other end of said first distributed constant transmission line is connected to said reference potential through a series connection between said second capacitor and the third distributed constant transmission line, and is connected to said reference potential through the second impedance element, said distributed constant circuit being in a substantially open state with respect to a first frequency, and being in a substantially short-circuited state with respect to a second frequency different from said first frequency.

16. A distributed constant circuit comprising:

a first distributed constant transmission line;

a capacitor;

a second distributed constant transmission line connected in series with said capacitor; and an impedance element, said distributed constant circuit having a structure in which one end of said first distributed constant transmission line is connected to a predetermined reference potential in an alternating current manner, and the other end of said first line is connected to said reference potential through a series connection between said capacitor and the second distributed constant transmission line, and is connected to said reference potential through said impedance element, said distributed constant circuit being in a substantially open state with respect to a first frequency, and being in a substantially short-circuited state with respect to a second frequency different from said first frequency.

* * * * *